US008997287B2

(12) United States Patent
Lanning et al.

(10) Patent No.: US 8,997,287 B2
(45) Date of Patent: Apr. 7, 2015

(54) METHOD AND APPARATUS FOR REMOVING MOISTURE FROM A MATTRESS TOPPER

(71) Applicant: Hill-Rom Services, Inc., Batesville, IN (US)

(72) Inventors: Mark Lanning, Mt. Pleasant, SC (US); Charles A. Lachenbruch, Lakeway, TX (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 14/196,315

(22) Filed: Mar. 4, 2014

(65) Prior Publication Data

US 2014/0250604 A1 Sep. 11, 2014

Related U.S. Application Data

(60) Provisional application No. 61/774,703, filed on Mar. 8, 2013.

(51) Int. Cl.
*A47C 21/04* (2006.01)
*A61G 7/057* (2006.01)

(52) U.S. Cl.
CPC ..... *A61G 7/057* (2013.01); *A61G 2007/05784* (2013.01); *A61G 2210/90* (2013.01)

(58) Field of Classification Search
USPC ..... 5/421, 423, 713–715, 724, 652.1, 726
See application file for complete search history.

(56) References Cited

U.S. PATENT DOCUMENTS

2013/0067661 A1* 3/2013 Schwirian et al. ..... 5/600

* cited by examiner

*Primary Examiner* — Fredrick Conley
(74) *Attorney, Agent, or Firm* — Barnes & Thornburg LLP

(57) ABSTRACT

A patient support apparatus includes a pressurized air source, a dehumidifier, and a support surface including a topper having a vapor-permeable surface. The dehumidifier is configured to selectively treat pressurized air communicated to the dehumidifier from the pressurized air source and communicate the treated pressurized air to the vapor-permeable surface.

20 Claims, 15 Drawing Sheets

METHOD AND APPARATUS FOR REMOVING MOISTURE FROM A MATTRESS TOPPER

CROSS-REFERENCE TO RELATED U.S. PATENT APPLICATION

This present application claims priority under 35 U.S.C. §119(e) to U.S. Provisional Patent Application Ser. No. 61/774,703, entitled "METHOD AND APPARATUS FOR REMOVING MOISTURE FROM A MATTRESS TOPPER," which was filed on Mar. 8, 2013, the entirety of which is hereby incorporated by reference.

BACKGROUND

The present disclosure is related to a patient support apparatus, and in particular to a method of removing moisture from a mattress topper included in the patient support apparatus. More particularly, the present disclosure is related to a method of removing moisture from a mattress topper using a blower included in the patient support apparatus.

A patient support apparatus may include a moisture removal system typically used to cool and dry a patient's skin to improve the health of the patient while the patient rests on the patient support apparatus. The cooling and drying of the patient's skin reduces the possibility of decubitus ulcers (bed sores) that may developed by the patient while he/she rests on the patient support apparatus.

Some moisture removal systems conduct ambient air through a topper included in the mattress and along the interface of the patient's skin with the topper. Such systems may utilize a blower to conduct ambient air through the moisture removal system and to the topper. Such systems rely on the ability of the ambient air to absorb moisture from the patient that passes into the topper.

SUMMARY

The present application discloses one or more of the features recited in the appended claims and/or the following features which, alone or in any combination, may comprise patentable subject matter:

According to one aspect of the present disclosure, a patient support apparatus comprises a patient support surface, a source of pressurized air, a dehumidifier, and a conduit. The patient support surface includes a topper having an upwardly-facing surface that is vapor permeable. The dehumidifier is in fluid communication with the source of pressurized air to receive pressurized air therefrom. The dehumidifier is operable to selectively treat the pressurized air to reduce the moisture content of the pressurized air. The conduit is coupled to the dehumidifier to conduct the pressurized air from the dehumidifier to the topper.

In some embodiments, the dehumidifier may include a first dryer that may include a first desiccant. The first desiccant may be configured to absorb moisture from the pressurized air. The first dryer may also include a heat source that may be configured to regenerate the first desiccant when the first desiccant is no longer able to absorb moisture from the pressurized air so that the first desiccant is able to absorb moisture from the pressurized air after regeneration is completed.

In some embodiments, the dehumidifier may include a second dryer that may include a second desiccant. The second desiccant may be configured to absorb moisture from the pressurized air. The second dryer may also include a second heat source that may be configured to regenerate the second desiccant when the second desiccant is no longer able to absorb moisture from the pressurized air so that the second desiccant is able to absorb moisture from the pressurized air after regeneration is completed.

In some embodiments, the pressurized air source may be a blower that may be coupled to the dehumidifier. The blower may be configured to drive pressurized air toward the topper. In other embodiments, the pressurized air source may be a compressor that may be coupled to the dehumidifier. The compressor may be configured to drive pressurized air toward the topper.

In some embodiments, the patient support apparatus may further comprise a first control valve. The first control valve may fluidly couple the blower to the first dryer. The first control valve may be operable to selectively direct pressurized air communicated to the first control valve from the blower to at least one of the first dryer and a second control valve. The first dryer may be bypassed when the first control valve directs pressurized air to the second control valve.

In some embodiments, the patient support apparatus may further comprise a controller. The controller may include a processor and also may include memory having instructions stored therein. The first control valve may be coupled to the controller. The instructions may be executable by the processor to cause the first control valve to direct pressurized air communicated to the first control valve by the blower to at least one of the first dryer and the second control valve.

In some embodiments, the patient support apparatus may further comprise a user interface. The user interface may include a display. The patient support apparatus may further comprise a sensor. The sensor may be coupled to the controller. The sensor may be configured to measure the relative humidity of the pressurized air communicated from the blower to the first control valve. The sensor may also be configured to communicate the relative humidity measurement to the controller so that the measurement is displayed on the display.

According to another aspect of the present disclosure, the patient support apparatus comprises a patient support surface, a pressurized air source, a dehumidifier, and a conduit. The support surface includes a topper having an upwardly-facing surface that is vapor permeable. The dehumidifier is in fluid communication with the blower. The dehumidifier is operable to selectively reduce the moisture content of ambient air provided to the dehumidifier so that it becomes treated air. The dehumidifier is operable to communicate treated air to the pressurized air source. The conduit may be coupled to the pressurized air source to conduct treated air from the pressurized air source to the topper.

In some embodiments, the dehumidifier may include a first dryer that may include a first desiccant. The first desiccant may be configured to absorb moisture from the ambient air so that it becomes treated air. The first dryer may also include a first heat source that may be configured to regenerate the first desiccant when the first desiccant is no longer able to absorb moisture from the ambient air so that the first desiccant is able to absorb moisture from the ambient air after regeneration is completed.

In some embodiments, the dehumidifier may include a second dryer that may include a second desiccant. The second desiccant may be configured to absorb moisture from the treated air to reduce the moisture content of the treated air. The second dryer may also include a second heat source that may be configured to regenerate the second desiccant when the second desiccant is no longer able to absorb moisture from the treated air so that the second desiccant is able to absorb moisture from the treated air after regeneration is completed.

In some embodiments, the patient support apparatus may further comprise a first control valve and also a second control valve. The second control valve may be fluidly coupled to the first control valve. Ambient air may be provided to the first control valve. The first control valve may be operable to selectively direct ambient air to at least one of the first dryer and the second control valve. The first dryer may be bypassed when the first control valve directs ambient air to the second control valve.

In some embodiments, the patient support apparatus may further comprise a controller. The controller may include a processor and also memory having instructions stored therein. The first control valve may be coupled to the controller. The instructions may be executable by the processor to cause the first control valve to direct ambient air to the first dryer. The instructions may also be executable by the processor to cause the first control valve to direct ambient air to the second control valve to bypass the first dryer.

According to another aspect of the present disclosure, a patient support apparatus comprises a patient support surface, a source of pressurized air, a dehumidifier, and a conduit. The patient support surface includes a topper having an upwardly-facing surface that is vapor permeable. The dehumidifier is in fluid communication with the source of pressurized air to receive pressurized air therefrom. The dehumidifier is operable to selectively treat the pressurized air to reduce the moisture content of the pressurized air. The conduit is coupled to the dehumidifier to conduct the pressurized air from the dehumidifier to the topper. The dehumidifier includes a first dryer that includes a first desiccant and a second dryer that includes a second desiccant.

In some embodiments, the patient support apparatus may further comprise a first control valve. The pressurized air source may be fluidly coupled to a first port that may be included in the first control valve. The first dryer may be fluidly coupled to a second port that may be included in the first control valve.

In some embodiments, the patient support apparatus may further comprise a second control valve. The first dryer may be fluidly coupled to a first port that may be included in the second control valve. The second dryer may be fluidly coupled to a second port that may be included in the second control valve.

In some embodiments, the patient support apparatus may further comprise a third control valve. The second dryer may be fluidly coupled to a first port that may be included in the third control valve. The conduit may be fluidly coupled to a second port that may be included in the third control valve.

In some embodiments, the patient support apparatus may further comprise a fourth control valve. The first control valve may be fluidly coupled to a first port that may be included in the fourth control valve. The third control valve may be fluidly coupled to a second port that may be included in the fourth control valve.

In some embodiments, the patient support apparatus may further comprise first sensor. The first sensor may be configured to measure the relative humidity of pressurized air communicated from the pressurized air source to the first port of the first control valve.

In some embodiments, the patient support apparatus may further comprise a second sensor. The second sensor may be configured to measure the relative humidity of pressurized air communicated from the first dryer to the first port of the second control valve. The second sensor may be configured to measure the relative humidity of pressurized air treated using the first dryer.

In some embodiments, the patient support apparatus may further comprise a third sensor. The third sensor may be configured to measure the relative humidity of pressurized air communicated from the second dryer to the first port of the third control valve. The third sensor may be configured to measure the relative humidity of pressurized air treated using the second dryer. The third sensor may also be configured to measure the relative humidity of pressurized air treated using the first dryer and the second dryer.

According to another aspect of the present disclosure, a method for removing moisture from a support surface included in a patient support apparatus on which a patient rests comprises measuring the relative humidity of pressurized air provided by a pressurized air source included in the patient support apparatus using a first sensor included in the patient support apparatus, communicating the relative humidity measurement provided by the first sensor to a controller included in the patient support apparatus, determining whether the relative humidity measurement exceeds a first predetermined value using the controller, and if the relative humidity measurement exceeds the first predetermined value, issuing a first output signal from the controller to a first control valve included in the patient support apparatus to cause pressurized air communicated to the first control valve from the pressurized air source to be communicated from the first control valve to a first dryer included in a dehumidifier that is included in the patient support apparatus, treating the pressurized air using the first dryer to reduce the moisture content of the pressurized air, and communicating the treated pressurized air from the first dryer toward the support surface to remove moisture from the patient accumulating on the support surface.

In some embodiments, if the relative humidity measurement exceeds the first predetermined value, the method may further comprise measuring the relative humidity of the treated pressurized air communicated toward the support surface by the first dryer using a second sensor included in the patient support apparatus. The method may further comprise communicating the relative humidity measurement provided by the second sensor to the controller. The method may further comprise determining whether the relative humidity measurement provided by the second sensor exceeds a second predetermined value using the controller.

In some embodiments, if the relative humidity measurement provided by the second sensor exceeds the second predetermined value, the method may further comprise issuing a second output signal from the controller to a second control valve included in the patient support apparatus to cause treated pressurized air communicated to the second control valve from the first dryer to be communicated from the second control valve to a second dryer included in the dehumidifier. The method may further comprise treating the treated pressurized air communicated from the second control valve to the second dryer using the second dryer to reduce the moisture content of the treated pressurized air. The method may further comprise communicating the treated pressurized air from the second dryer toward the support surface to remove moisture from the patient accumulating on the support surface. The method may further comprise measuring the relative humidity of the treated pressurized air communicated from the second dryer toward the support surface using a third sensor included in the patient support apparatus. The method may further comprise communicating the relative humidity measurement provided by the third sensor to the controller. The method may further comprise issuing a third output signal from the controller to a third control valve included in the patient support apparatus to cause treated pressurized air communicated to the third control valve from the second dryer to be communicated from the third control valve through a conduit included in the patient support apparatus and to the support surface so that the treated pressurized air is used to remove moisture from the patient accumulating on the support surface.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
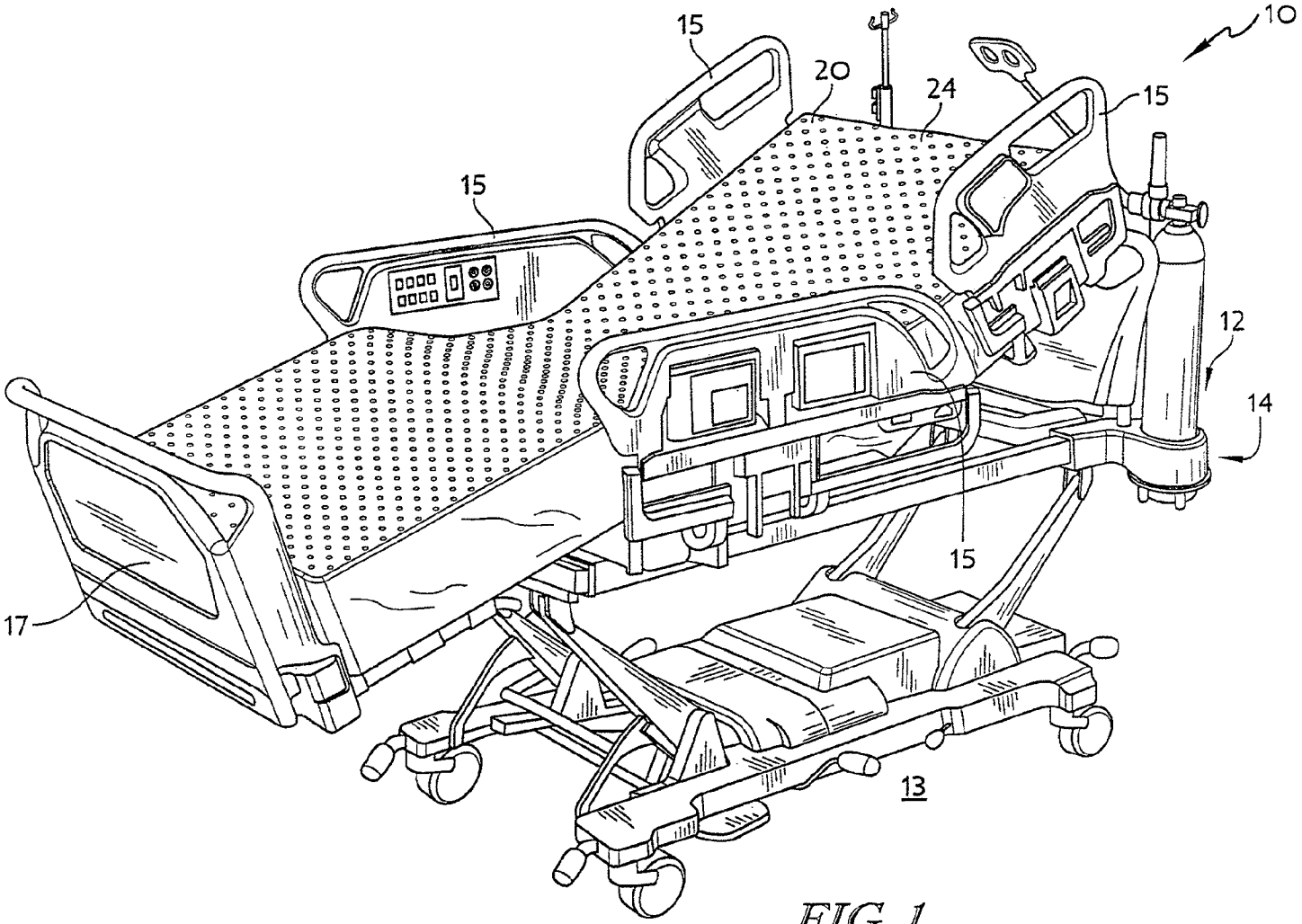
FIG. 1 is a perspective view of a first embodiment of a patient support apparatus in accordance with the present disclosure.

Referring to FIG. 1, a patient support apparatus is illustratively embodied as a hospital bed 10 in a first embodiment of the present disclosure. The bed 10 includes a moisture removal system 12 that is mounted to a support frame 14 also included in the bed 10 that supports the moisture removal system 12 above a floor 13 on which the bed 10 rests. The moisture removal system 12 is arranged to underlie a patient supported on the bed 10. The moisture removal system 12 is configured to cool and dry the patient's skin to promote skin health by moving air along a top surface of a mattress 20 included in the bed 10, also referred to as a support surface 20, when the patient is supported on the bed 10. The moisture removal system 12 includes a pressurized air source 16 and a dehumidifier 18 as shown in FIG. 2B.

The patient is supported by the support surface 20 that is configured to underlie the patient resting on the bed 10. The support surface 20 includes a topper 22 which defines a top face 24 of the support surface 20 and is configured to conduct pressurized air provided by the pressurized air source 16 along the top face 24 when the patient is supported on the bed 10. For the purposes of the present disclosure, pressurized air refers to air that has a pressure greater than the pressure of ambient or atmospheric air. The pressurized air is produced by the pressurized air source 16 and routed to the support surface 20 through a conduit 25 included in the moisture removal system 12 of the bed 10. The pressurized air provided by the pressurized air source 16 may be pressurized air which is treated using the dehumidifier 18 so that the moisture content of the pressurized air is reduced prior to being conducted along the top face 24. The pressurized air provided by the pressurized air source 16 may also be pressurized air that has not been treated using the dehumidifier 18 prior to being conducted to the support surface 20.

The bed 10 also includes a control unit 26 which includes a controller 28, a plurality of sensors, and a plurality of control valves which are described in more detail below and shown in FIG. 2B. The control unit 26 provides data regarding the moisture content of the pressurized air provided by the pressurized air source 16, including one or more relative humidity measurements taken at various locations in the moisture removal system 12. The control unit 26 is configured to direct the operation of the dehumidifier 18 so that the dehumidifier 18 is operable to selectively treat the pressurized air provided by the pressurized air source 16.

Referring again to FIG. 1, the bed 10 includes the support frame 14 which is supported by wheels or casters, the support surface 20, a number of siderails 15, and a footboard 17. The bed 10 may also include a headboard (not shown). The pressurized air source 16 and the dehumidifier 18 of the moisture removal system 12 are coupled to the support frame 14 as suggested in FIG. 2B. The support surface 20 is supported on the support frame 14 as shown in FIG. 2B.

Figure 2A:
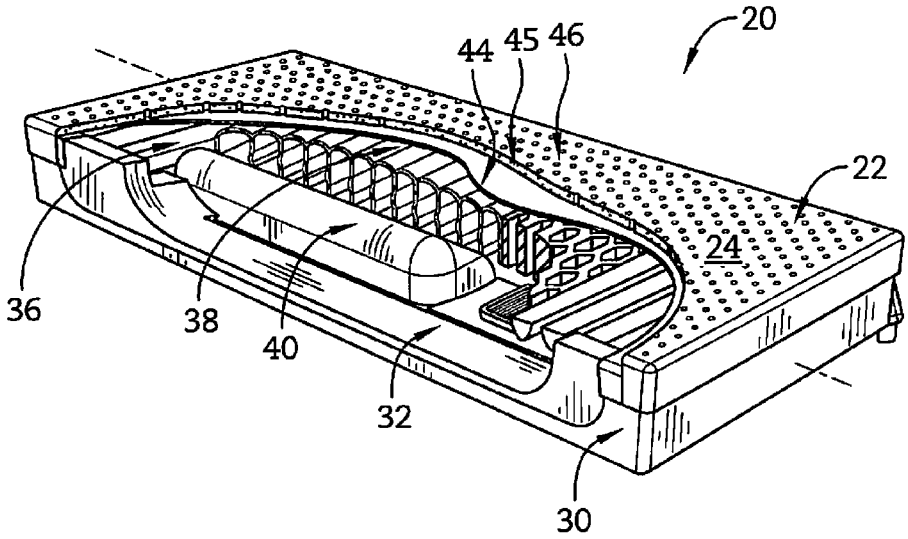
FIG. 2A is a cutaway perspective view of a mattress included in the patient support apparatus of FIG. 1.
Figure 2B:
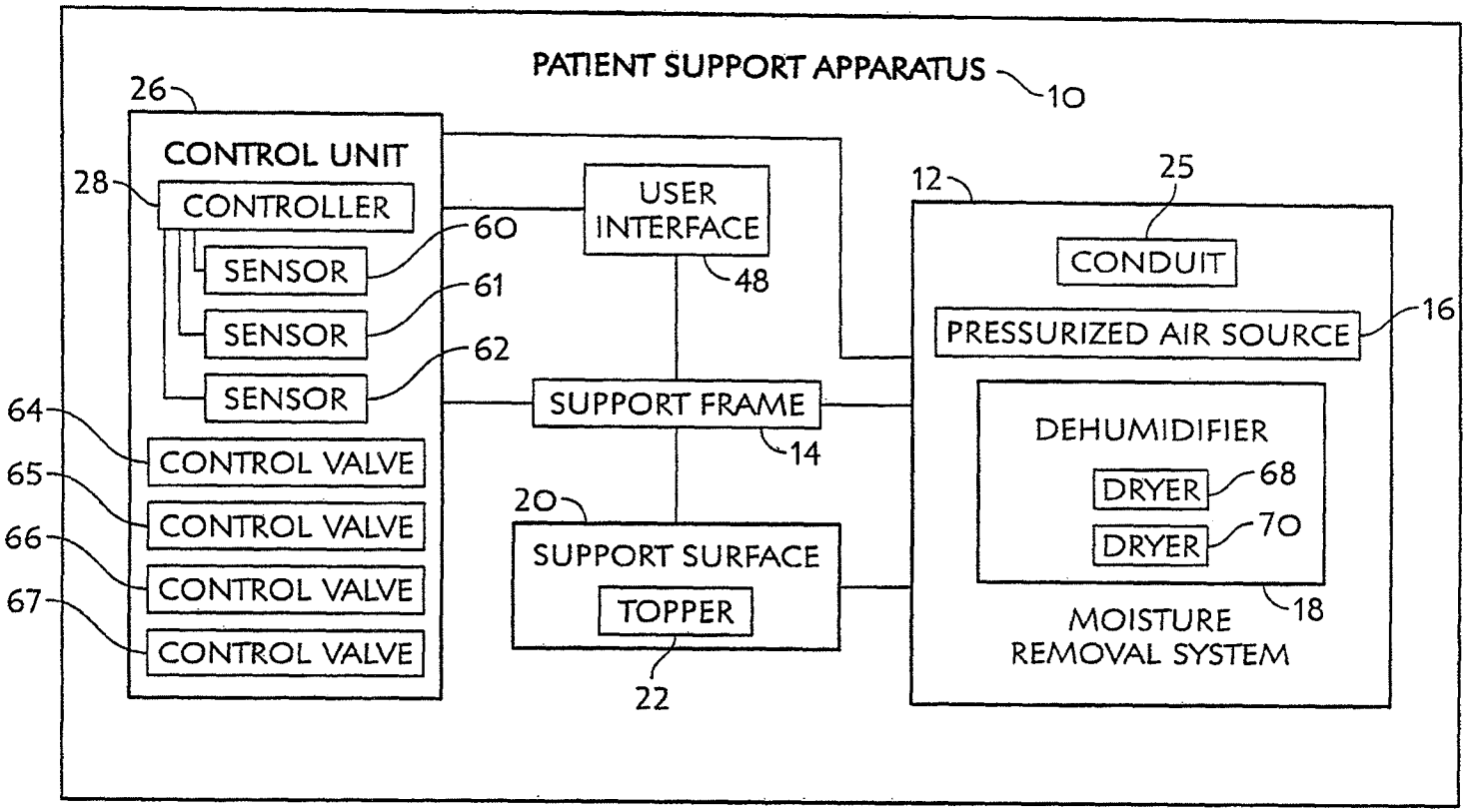
FIG. 2B is a diagrammatic view showing various components included in the patient support apparatus of FIG. 1.

Referring to FIG. 2A, the support surface or mattress 20 includes the topper 22 and a lower ticking 30 that cooperate to encase a foam shell 32, a foam head section 34, a foam foot section 36, body bladders 38, and turn bladders 40 as shown, for example, in FIG. 1. The topper 22 forms the top face 24 of the support surface 20 and is configured to conduct pressurized air provided by the pressurized air source 16 along the top face 24 when the patient is supported on the bed 10. The foam components 32, 34, 36 and the bladders 38, 40 cooperate to support the patient when the patient is supported on the bed 10.

Figure 4:
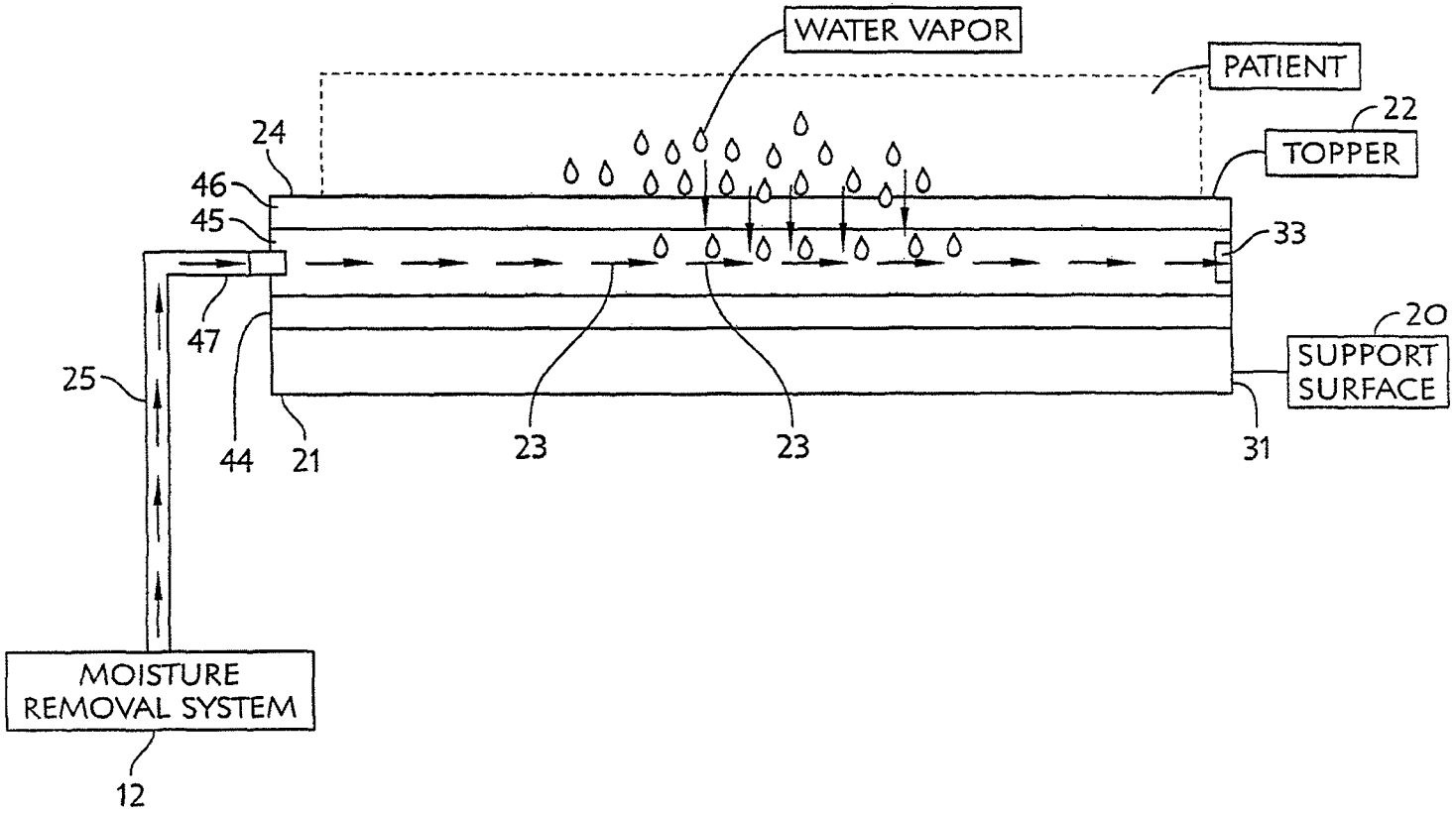
FIG. 4 is a side view of a support surface included in the patient support apparatus of FIG. 1 that includes a topper having pressurized air flowing therethrough.

The topper 22 illustratively includes a bottom layer 44, a middle layer 45, and a top layer 46 as shown in FIGS. 2A and 4. The middle layer 45 is illustratively a three-dimensional material that allows pressurized air to flow between the bottom layer 44 and the top layer 46 along the top face 24 from a foot end 21 to a head end 31 of the support surface 20 as suggested by arrows 23 in FIG. 4. The top layer 46 is made from a vapor-permeable material that allows moisture from the patient supported on the topper 22 to pass through the top layer 46 and be carried away for evaporation by pressurized air flowing through the middle layer 45 of the topper 22.

Figure 3A:
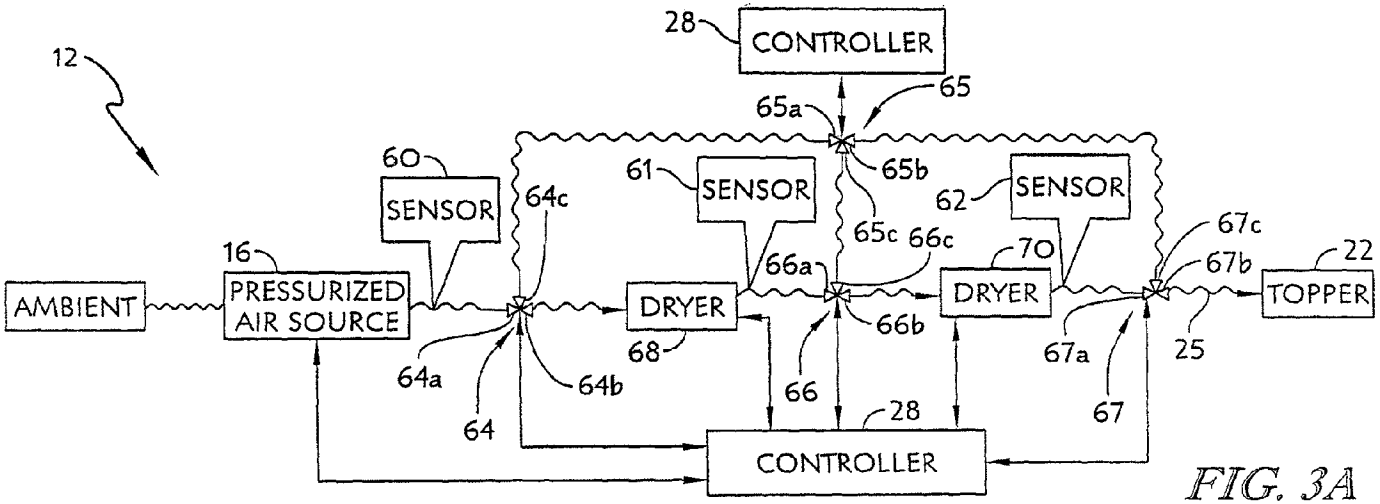
FIG. 3A is a diagrammatic view showing the various components of FIG. 2B in a first arrangement and associated paths of pressurized air flow therebetween.

Referring now to FIG. 2B, the moisture removal system 12 includes the pressurized air source 16 and the dehumidifier 18 as indicated above. The pressurized air source 16 is configured to receive ambient air surrounding the bed 10 and pressurize the ambient air so that it becomes pressurized air. The pressurized air source 16 is configured to drive the pressurized air toward the dehumidifier 18 and the topper 22 as illustrated in FIG. 3A. The dehumidifier 18 receives pressurized air from the pressurized air source 16 as shown in FIG. 3A and includes a first dryer 68 and a second dryer 70. Each dryer 68, 70 is configured to treat the pressurized air by reducing the moisture content of the pressurized air that passes through the dryer and communicate the treated pressurized air toward the topper 22 as discussed in more detail below.

The pressurized air source 16 may be a mechanical fan or blower including a casing and an impeller and a hub contained by the casing. The fan or blower may also include a motor used to rotate the impeller to propel pressurized air toward the dehumidifier 18. The pressurized air source 16 may also be a compressor that is used to reduce the volume of the ambient air by increasing its pressure and thereby propelling pressurized air toward the dehumidifier 18.

The bed 10 includes the control unit 26 and a user interface 48 as shown in FIG. 2B. The control unit 26 and the user interface 48 are coupled to the support frame 14 and the control unit 26 is coupled to the user interface 48. The control unit 26 is configured to communicate data to the user interface 48 so that it may be displayed on a display (not shown) included in the user interface 48. For instance, the relative humidity measurements provided by each one of the plurality of sensors included in the control unit 26 may be communicated to the user interface 48 and displayed on the display of the user interface 48. The user interface 48 may also include a plurality of switches (not shown) that may be selectively engaged by a user to provide user input to the control unit 26 in response to the data communicated from the control unit 26 to the user interface 48.

Figure 6:
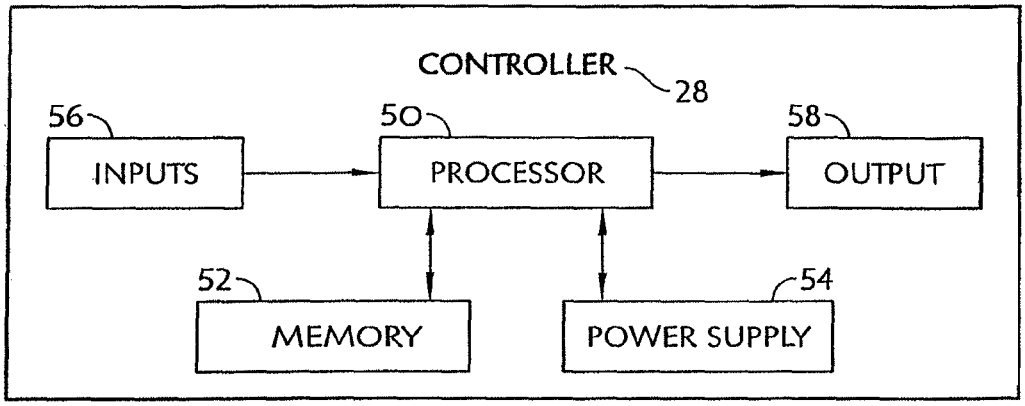
FIG. 6 is a diagrammatic view of a dryer included in the patient support apparatus of FIG. 1.

The control unit 26 includes the controller 28 which manages electronically controlled functions associated with the bed 10. As shown in FIG. 6, the controller 28 includes a processor 50 and memory 52. The processor 50 receives power from a power supply 54. The power supply 54 may be mounted to the bed 10 or located within a patient's room where the bed 10 resides. The processor 50 is configured to execute instructions stored in memory 52. The controller 28 is configured to receive input signals from one or more inputs 56 that are coupled to the controller 28. As discussed below, the inputs 56 include the plurality of sensors included in the control unit 26. The controller 28 is also configured to transmit output signals to one or more outputs 58 that are coupled to the controller 28. The outputs 58 include the plurality of control valves included in the control unit 26 as discussed below. The controller 28 may be contained within a housing that is mountable to a fixed location on the support frame 14. The housing may also contain electrical circuitry included with the controller 28.

The control unit 26 also includes the plurality of sensors and the plurality of control valves as indicated above and shown in FIG. 2B. The plurality of sensors includes a first sensor 60, a second sensor 61, and a third sensor 62 as shown in FIG. 2B. The plurality of control valves includes a first control valve 64, a second control valve 65, a third control valve 66, and a fourth control valve 67 as shown in FIG. 2B.

Each of the sensors 60, 61, 62 are illustratively relative humidity sensors coupled to the controller 28 and configured to provide relative humidity measurements to the controller 28 of pressurized air provided by the pressurized air source 16 and conducted through the moisture removal system 12 to the support surface 20. As suggested above, each of the sensors 60, 61, 62 are included as inputs 56.

Referring now to FIG. 3A, the moisture removal system 12 is arranged in a first configuration in a first embodiment of the present disclosure in which the dryers 68, 70 are placed in series with one another and the pressurized air source 16 is located upstream of each dryer 68, 70 relative to the ambient. The first sensor 60 is positioned between the pressurized air source 16 and the dehumidifier 18 to provide a relative humidity measurement of pressurized air prior to treatment using the dehumidifier 18. The second sensor 61 is positioned between the first dryer 68 and the second dryer 70 included in the dehumidifier 18 to provide a relative humidity measurement of pressurized air treated using the first dryer 68 prior to subsequent treatment using the second dryer 70. The third sensor 62 is positioned between the second dryer 70 and the topper 22 to provide a relative humidity measurement of pressurized air treated using both dryers 68, 70 or using only the second dryer 70.

Each of the control valves 64, 65, 66, 67 is illustratively a 3-way valve configured to permit air flow between two of three different ports included in each control valve as shown in FIG. 3A. Each of the control valves 64, 65, 66, 67 is coupled to the controller 28 as shown in FIG. 3A. As suggested above, each of the control valves 64, 65, 66, 67 are included as outputs 58.

As shown in FIG. 3A, the first control valve 64 is positioned between the first sensor 60 and the first dryer 68 of the dehumidifier 18. The first control valve 64 is fluidly coupled to the pressurized air source 16 at a first inlet port 64*a* as shown in FIG. 3A. The first control valve 64 is fluidly coupled to an inlet of the first dryer 68 at a second outlet port 64*b* as shown in FIG. 3A. The first control valve 64 is fluidly coupled to the second control valve 65 at a third outlet port 64*c* as shown in FIG. 3A.

The first control valve 64 is operable to direct the flow of pressurized air generated by the pressurized air source 16 and communicated to the first control valve 64 at the first inlet port 64*a* to at least one of the second outlet port 64*b* and the third outlet port 64*c*. As previously mentioned, the first control valve 64 is in communication with the controller 28 to receive output signals therefrom. The controller 28 may, in response to receiving a relative humidity measurement of the pressurized air from the first sensor 60, transmit a first control valve output signal A to the first control valve 64 to cause pressurized air to be directed from the first inlet port 64*a* to the second outlet port 64*b*. In another example, the controller 28, in response to receiving the relative humidity measurement from the first sensor 60, may transmit a first control valve output signal B to the first control valve 64 to cause pressurized air to be directed from the first inlet port 64*a* to the third outlet port 64*c*.

As shown in FIG. 3A, the second control valve 65 is positioned between the second sensor 61 and the second dryer 70 of the dehumidifier 18. The second control valve 65 is fluidly coupled to the first control valve 64 at a first port 65*a* as shown in FIG. 3A. The second control valve 65 is fluidly coupled to the fourth control valve 67 at a second port 65*b* as shown in FIG. 3A. The second control valve 65 is fluidly coupled to the third control valve 66 at a third port 65*c* as shown in FIG. 3A.

The second control valve 65 is operable to direct the flow of pressurized air generated by the pressurized air source 16 and communicated to the second control valve 65 at the first port 65*a* to at least one of the second port 65*b* and the third port 65*c*. The second control valve 65 is also operable to direct the flow of treated pressurized air communicated to the second control valve 65 at port 65*c* to the port 65*b*. As previously mentioned, the second control valve 65 is in communication with the controller 28 to receive output signals therefrom. The controller 28 may, in response to receiving a relative humidity measurement of the pressurized air provided by the pressurized air source 16 from the first sensor 60, transmit a second control valve output signal A to the second control valve 65 to cause pressurized air to be directed from the first port 65*a* to the second port 65*b*. In another example, the controller 28, in response to receiving the relative humidity measurement from the first sensor 60, may transmit a second control valve output signal B to the second control valve 65 to cause pressurized air to be directed from the first port 65*a* to the third port 65*c*. In yet another example, the controller 28, in response to receiving the relative humidity measurement from the second sensor 61, may transmit a second control valve output signal C to the second control valve 65 to cause pressurized air to be directed from the third port 65*c* to the second port 65*b*.

As shown in FIG. 3A, the third control valve 66 is positioned between the second sensor 61 and the second dryer 70 of the dehumidifier 18. The third control valve 66 is fluidly coupled to an outlet of the first dryer 68 of the dehumidifier 18 at a first port 66*a* as shown in FIG. 3A. The third control valve 66 is fluidly coupled to an inlet of the second dryer 70 of the dehumidifier 18 at second port 66*b* as shown in FIG. 3A. The third control valve 66 is fluidly coupled to the second control valve 65 at a third port 66*c* as shown in FIG. 3A.

The third control valve 66 is operable to direct the flow of pressurized air generated by the pressurized air source 16 and communicated to the third control valve 66 at the third port 66*c* to the second port 66*b*. The third control valve 66 is also operable to direct the flow of treated pressurized air communicated to the third control valve 66 at the first port 66*a* to at least one of the third port 66*c* and the second port 66*b*. As previously mentioned, the third control valve 66 is in communication with the controller 28 to receive output signals therefrom. The controller 28 may, in response to receiving a relative humidity measurement of the treated pressurized air from the second sensor 61, transmit a third control valve output signal A to the third control valve 66 to cause treated pressurized air to be directed from the first port 66*a* to the second port 66*b*. In another example, the controller 28, in response to receiving the relative humidity measurement from the second sensor 61, may transmit a third control valve output signal B to the third control valve 66 to cause treated pressurized air to be directed from the first port 66*a* to the third port 66*c*, thereby bypassing the second dryer 70. In yet another example, the controller 28, in response to receiving the relative humidity measurement from the first sensor 60, may transmit a third control valve output signal C to the third control valve 66 to cause pressurized air to be directed from the third port 66*c* to the second port 66*b* for treatment using the second dryer 70.

As shown in FIG. 3A, the fourth control valve 67 is positioned between the third sensor 62 and the topper 22. The fourth control valve 67 is fluidly coupled to an outlet of the second dryer 70 of the dehumidifier 18 at a first port 67*a* as shown in FIG. 3A. The fourth control valve 67 is fluidly coupled to the topper 22 at a second port 67*b* as shown in FIG. 3A. The fourth control valve 67 is fluidly coupled to the second control valve 65 at a third port 67*c* as shown in FIG. 3A.

The fourth control valve 67 is operable to direct the flow of pressurized air communicated to the fourth control valve 67 at either one of the first port 67*a* and the third port 67*c* to the second port 67*b*. It should be understood that the first port 67*a* receives treated pressurized air that is treated by the second dryer 70 or both dryers 68, 70. It should also be understood that the third port 67*c* receives either (non-treated) pressurized air or treated pressurized air that is treated using the first dryer 68. As previously mentioned, the fourth control valve 67 is in communication with the controller 28 to receive output signals therefrom. The controller 28 may, in response to receiving a relative humidity measurement of the pressurized air provided by the pressurized air source 16 from the first sensor 60, the second sensor 61, and/or the third sensor 62, transmit a fourth control valve output signal A to the fourth control valve 67 to cause treated pressurized air to be directed from the first port 67*a* to the second port 67*b*. In another example, the controller 28, in response to receiving the relative humidity measurement from the first sensor 60, the second sensor 61, and/or the third sensor 62, may transmit a fourth control valve output signal B to the fourth control valve 67 to cause either (non-treated) pressurized air or treated pressurized air to be directed from the third port 67*c* to the second port 67*b*.

Figure 5:
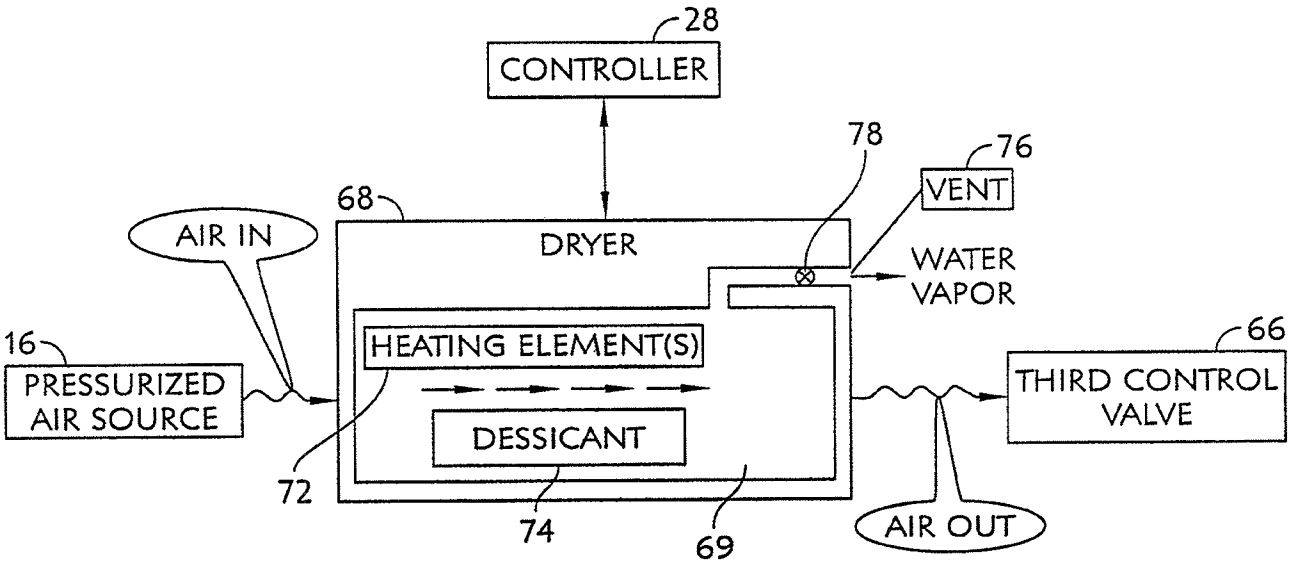
FIG. 5 is a diagrammatic view of a controller included in the patient support apparatus of FIG. 1.

As suggested in FIG. 5, the first dryer 68 includes a first housing that defines a first treatment chamber 69 in which pressurized air provided by the pressurized air source 16 is treated. The first dryer 68 includes a first heat source 72 and a first desiccant 74 that are contained within the first treatment chamber 69. The first dryer 68 also includes a first vent 76 that is in fluid communication with the first treatment chamber 69. The first dryer 68 is configured to treat pressurized air in the first treatment chamber 69 so that the moisture content of the pressurized air is reduced. In other words, the first dryer 68 operates to reduce moisture of the pressurized air so that the relative humidity of the AIR OUT is less than the relative humidity of the AIR IN.

The first desiccant 74 is configured to absorb moisture from the AIR IN so that the AIR OUT has a lower relative humidity than the AIR IN as previously stated. The first desiccant 74 is illustratively a synthetic porous crystalline aluminosilicate such as a silica gel desiccant. As an example, approximately one pound of silica gel desiccant is able to absorb about 50% of the moisture of standard air coming in contact with the silica gel desiccant over a time period of approximately one hour. Standard air has an absolute pressure of 14.7 psi at a temperature of approximately 70° F. and is provided to the silica gel desiccant at a rate of approximately 80 L/min for the purposes of the present disclosure.

Moisture absorbed by the first desiccant 74 becomes water vapor as shown in FIG. 5. Water vapor accumulated within the first treatment chamber 69 may be expelled through the first vent 76 as suggested in FIG. 5. The first dryer 68 also includes a bleed valve 78 positioned within the first vent 76 that is operable to permit water vapor accumulating in the first treatment chamber 69 to be expelled through the first vent 76 to the ambient.

The first desiccant 74 is configured to be regenerated once the first desiccant absorbs moisture to the point that the first desiccant 74 becomes saturated and is no longer able to absorb moisture from the pressurized air provided by the pressurized air source 16. The first desiccant 74 may be regenerated by heating it to a regeneration temperature using the heat source 72 for a sufficient period of regeneration time. In one example, the regeneration time may between 1-2 hours and the regeneration temperature may be between 200-300° F. As in explained in more detail below, the second dryer 70 may be used to treat the pressurized air supplied by the pressurized air source 16 while the first desiccant 74 is being regenerated.

For the purposes of the present disclosure, the second dryer 70 is considered to be similar to the first dryer 68. The second dryer 70 therefore includes a second housing defining a second treatment chamber, a second desiccant and a second heat source contained within the second treatment chamber, a second vent, and a second bleed valve. The second desiccant is configured to absorb moisture from the AIR IN so that the AIR OUT has a lower relative humidity than the AIR IN as previously stated. The second desiccant is illustratively a silica gel desiccant capable of being regenerated as described above. As explained in more detail below, the first dryer 68 may be used to treat the pressurized air supplied by the pressurized air source 16 while the second desiccant is being regenerated.

As shown in FIG. 3A, each of the dryers 68, 70 is coupled to the controller 28. Each dryer 68, 70 may include a sensor (not shown) located within the treatment chamber of each dryer. Each sensor may be a relative humidity sensor configured to provide data to the controller 28 concerning the relative humidity of the pressurized air being treated in the treatment chamber. In another example, each sensor may be a temperature sensor configured to provide data to the controller 28 concerning the temperature inside the treatment chamber. Each temperature sensor may be used to provide an indication to the controller 28 that the heat source of the dryer needs to be replaced.

Referring back to FIG. 3A, a method for removing moisture from the support surface 20 using the topper 22 is described below. The method may utilize both dryers 68, 70 to treat pressurized air provided by the pressurized air source 16 and communicate the treated pressurized air to the topper 22 through the conduit 25. The method may utilize the first dryer 68 to treat the pressurized air while bypassing the second dryer 70 and communicating the treated pressurized air to the topper 22 through the conduit 25. The method may utilize the second dryer 70 to treat the pressurized air while bypassing the first dryer 68 and communicating the treated pressurized air to the topper 22 through the conduit 25. The method may also bypass both the first dryer 68 and the second dryer 70 so that non-treated pressurized air provided by the pressurized air source 16 is communicated to the topper 22 through the conduit 25. For the purposes of the present disclosure, the steps in the method outlined below may be stored as instructions in memory 52 that are executable by the processor 50 of the controller 28.

The method includes the first step of measuring the relative humidity of the pressurized air exiting the pressurized air source 16 using the first sensor 60. The first sensor 60 provides a first relative humidity measurement of the pressurized air prior to treatment using the first dryer 68 or the second dryer 70.

The method proceeds by communicating the first relative humidity measurement provided by the first sensor 60 to the controller 28. The first relative humidity measurement provided by the first sensor 60 is communicated to the controller 28 as a first input signal.

The method proceeds by determining whether the first relative humidity measurement exceeds a first predetermined value using the controller 28. The first predetermined value may be a relative humidity value associated with a desired level of moisture removal from the patient's skin using the topper 22. If the first relative humidity measurement exceeds the first predetermined value, the method proceeds by issuing a first output signal to the first control valve 64 from the controller 28 to cause pressurized air to be communicated from the first inlet port 64*a* to the first dryer 68 through the second outlet port 64*b*. If the first relative humidity measurement does not exceed the first predetermined value, the method proceeds by issuing a second output signal to the first control valve 64 from the controller 28 to cause pressurized air to be communicated from the first inlet port 64*a* to the first port 65*a* of the second control valve 65 through the third outlet port 64*c*, thereby bypassing the first dryer 68.

If the second output signal is issued by the controller 28 to the first control valve 64, the method proceeds by issuing a third output signal to the second control valve 65 from the controller 28 to cause pressurized air to be communicated from the first port 65*a* to the fourth control valve 67 through the second port 65*b*. The second dryer 70 is thereby bypassed in this step.

If the third output signal is issued by the controller 28 to the second control valve 65, the method proceeds by issuing a fourth output signal to the fourth control valve 67 from the controller 28 to cause non-treated pressurized air to be communicated from the third port 67*c* toward the topper 22 through the second port 67*b*. Non-treated pressurized air communicated from the second port 67*b* toward the topper 22 is routed to the topper 22 using the conduit 25.

If the first output signal is issued by the controller 28 to the first control valve 64, the method proceeds by treating the pressurized air using the first dryer 68 as discussed above. Pressurized air treated using the first dryer 68 is routed past the second sensor 61 and to the third control valve 66 as shown in FIG. 3A.

Once the pressurized air is treated using the first dryer 68, the method proceeds by measuring the relative humidity of the treated pressurized air exiting the first dryer 68 using the second sensor 61. The second sensor 61 provides a second relative humidity measurement of the treated pressurized air prior to further treatment using the second dryer 70 as shown in FIG. 3A.

The method proceeds by communicating the second relative humidity measurement provided by the second sensor 61 to the controller 28. The second relative humidity measurement provided by the second sensor 61 is communicated to the controller 28 as a second input signal.

The method proceeds by determining whether the second relative humidity measurement exceeds a second predetermined value. The second predetermined value may be greater than, equal to, or less than the first predetermined value. The second predetermined value may be a relative humidity value associated with a desired level of moisture removal from the patient's skin using the topper 22. If the second relative humidity measurement exceeds the second predetermined value, the method proceeds by issuing a fifth output signal to the third control valve 66 from the controller 28 to cause treated pressurized air to be communicated from the first port 66*a* to the second dryer 70 through the second port 66*b*. If the second relative humidity measurement does not exceed the second predetermined value, the method proceeds by issuing a sixth output signal to the third control valve 66 from the controller 28 to cause treated pressurized air to be communicated from the first port 66*a* to the second control valve 65 through the third port 66*c*, thereby bypassing the second dryer 70.

If the sixth output signal is issued by the controller 28 to the third control valve 66, the method proceeds by issuing a seventh output signal to the second control valve 65 from the controller 28 to cause treated pressurized air to be communicated from the third port 65*c* to the fourth control valve 67 through the second port 65*b*. The second dryer 70 is thereby bypassed in this step.

If the seventh output signal is issued by the controller 28 to the second control valve 65, the method proceeds by issuing an eighth output signal to the fourth control valve 67 from the controller 28 to cause treated pressurized air to be communicated from the third port 67*c* toward the topper 22 through the second port 67*b*. Treated pressurized air communicated from the second port 67*b* toward the topper 22 is routed to the topper 22 using the conduit 25. It should be understood that treated pressurized air routed to the topper 22 following the issuance of the seventh output signal is treated only by the first dryer 68.

If the fifth output signal is issued by the controller 28 to the third control valve 66, the method proceeds by treating the treated pressurized air using the second dryer 70 as discussed above. Pressurized air treated using the second dryer 70 is routed past the third sensor 62 and to the fourth control valve 67 as shown in FIG. 3A. It should be understood that pressurized air routed to the second dryer 70 following the issuance of the fifth output signal is treated air that is to be treated a second time using the second dryer 70.

Once the treated pressurized air is treated for a second time using the second dryer 70, the method proceeds by measuring the relative humidity of the treated pressurized air exiting the second dryer 70 using the third sensor 62. The third sensor 62 provides a third relative humidity measurement of the treated pressurized air as shown in FIG. 3A.

The method proceeds by communicating the third relative humidity measurement provided by the third sensor 62 to the controller 28. The third relative humidity measurement provided by the third sensor 62 is communicated to the controller 28 as a third input signal.

Once the third relative humidity measurement provided by the third sensor 62 is communicated to the controller 28 as the third input signal, the method concludes by issuing a ninth output signal to the fourth control valve 67 from the controller 28 to cause pressurized air treated by both dryer 68, 70 to be communicated from the first port 67*a* toward the topper 22 through the second port 67*b*. Treated pressurized air communicated from the second port 67*b* toward the topper 22 is routed to the topper 22 using the conduit 25.

In the event that the first desiccant 74 of the first dryer 68 becomes saturated so that regeneration is required, the second relative humidity measurement provided by the second sensor 61 to the controller 28 may indicate that regeneration is required (i.e. the relative humidity of the air exiting the first dryer 68 is greater than it would be if the first desiccant 74 was not saturated and could absorb moisture). To that end, the controller 28 may issue a first regeneration signal to the first control valve 64 that causes non-treated pressurized air to be communicated from the first inlet port 64*a* to the second control valve 65 through the third outlet port 64*c*, thereby bypassing the first dryer 68 while the first desiccant 74 is being regenerated. The issuance of the first regeneration signal may prevent the controller 28 from issuing the first output signal to the first control valve 64 until regeneration of the first desiccant 74 is completed.

In the event that the second desiccant of the second dryer 70 becomes saturated so that regeneration is required, the third relative humidity measurement provided by the third sensor 62 to the controller 28 may indicate that regeneration is required (i.e. the relative humidity of the air exiting the second dryer 70 is greater than it would be if the second desiccant was not saturated and could absorb moisture). To that end, the controller 28 may issue a second regeneration signal to the third control valve 66 to cause treated pressurized air to be communicated from the first port 66*a* to the second control valve 65 through the third port 66*c*, thereby bypassing the second dryer 70 while the second desiccant is being regenerated. The second regeneration signal may also be issued by the controller 28 to the second control valve 65 to cause non-treated pressurized air to be communicated from the first port 65*a* to the fourth control valve 67 through the second port 65*b*. Issuance of the second regeneration signal may prevent the controller 28 from issuing the fifth output signal to the third control valve 66 until regeneration of the second desiccant is completed.

Figure 3B:
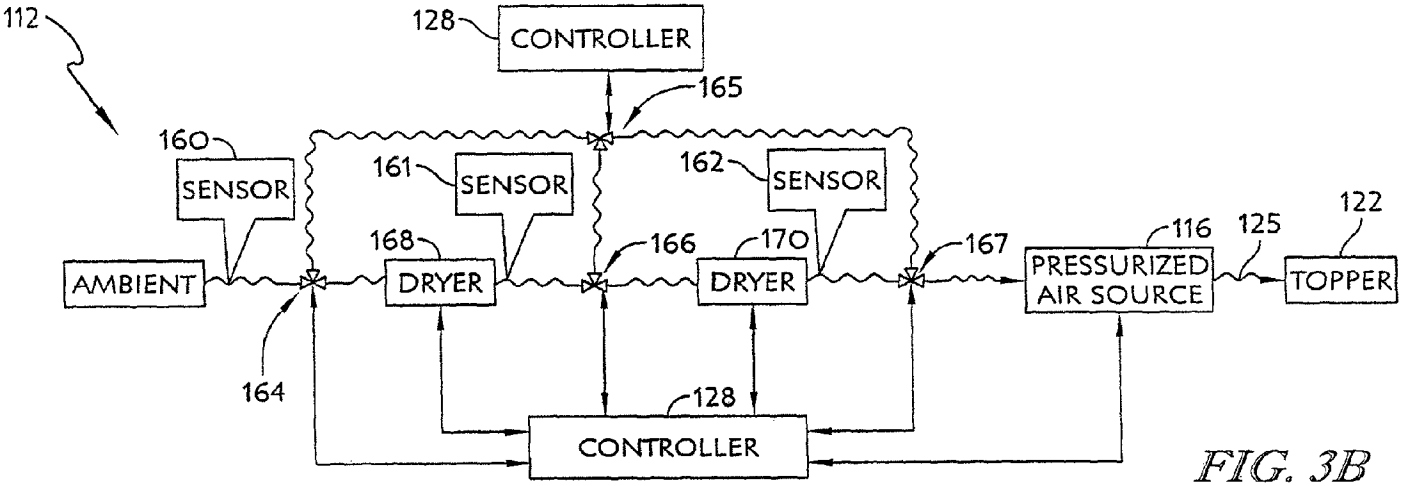
FIG. 3B is a diagrammatic view showing the various components of FIG. 2B in a second arrangement in accordance with a second embodiment of the present disclosure.

Referring now to FIG. 3B, the moisture removal system 112 is arranged in a second configuration in a second embodiment of present disclosure in which the dryers 168, 170 are placed in series with one another and the pressurized air source 116 is located downstream of each dryer 168, 170 relative to the ambient. The first sensor 160 is positioned between the ambient and the first control valve 164, and treated/non-treated pressurized air is communicated from the fourth control valve 167 to the pressurized air source 116. Air communicated to the pressurized air source 116 from the fourth control valve 167 is routed to the topper 122 thereafter through the conduit 125.

Except for the differences identified in the paragraph above, the first configuration of the moisture removal system 12 in the first embodiment of the present disclosure as illustrated in FIG. 3A is the same as the second configuration of the moisture removal system 112 of the second embodiment of the present disclosure as illustrated in FIG. 3B. The method for removing moisture from the support surface 20 using the topper 22 described with respect to FIG. 3A may be applied to the second configuration shown in FIG. 3B (note that air provided to the first control valve 164 is ambient air and that pressurized air is communicated to the conduit 125 from the pressurized air source 116 in FIG. 3B).

Referring now to FIG. 4, the flow of treated/non-treated pressurized air from the moisture removal system 12 through the topper 22 of the support surface 20 is shown in the first embodiment of the present disclosure. Treated pressurized air or non-treated pressurized air flows from the moisture removal system 12 to the topper 22 through the conduit 25 as shown in FIG. 4. The air provided by the moisture removal system 12 is communicated to the middle layer 45 of the topper 22 by a fitting 47 included in the support surface 20.

Air provided by the moisture removal system 12 to the topper 22 is conducted through the middle layer 45 in the direction shown by arrows 23 in FIG. 4. The air interacts with water vapor that passes through the vapor permeable top layer 46 and into the middle layer 45 as shown in FIG. 4. The water vapor originates from the patient resting on the support surface 20 as shown in FIG. 4.

Air provided by the moisture removal system 12 to the topper 22 evaporates the water vapor that passes into the middle layer 45 as suggested in FIG. 4. The air is communicated through the middle layer 45 from the foot end 21 to the head end 31 of the bed 10 and toward an exhaust 33 formed in the head end 31 of the middle layer 45. The air is expelled through the exhaust 33 to the ambient as shown in FIG. 4.

Air communicated to the topper 22 that is treated using one or both of the dryers 68, 70 has a greater capacity to evaporate the water vapor passing into the middle layer 45 than does non-treated air. Therefore, treated air tends to promote skin health for the patient supported on the support surface 20 to a greater degree than non-treated air.

Figure 7:
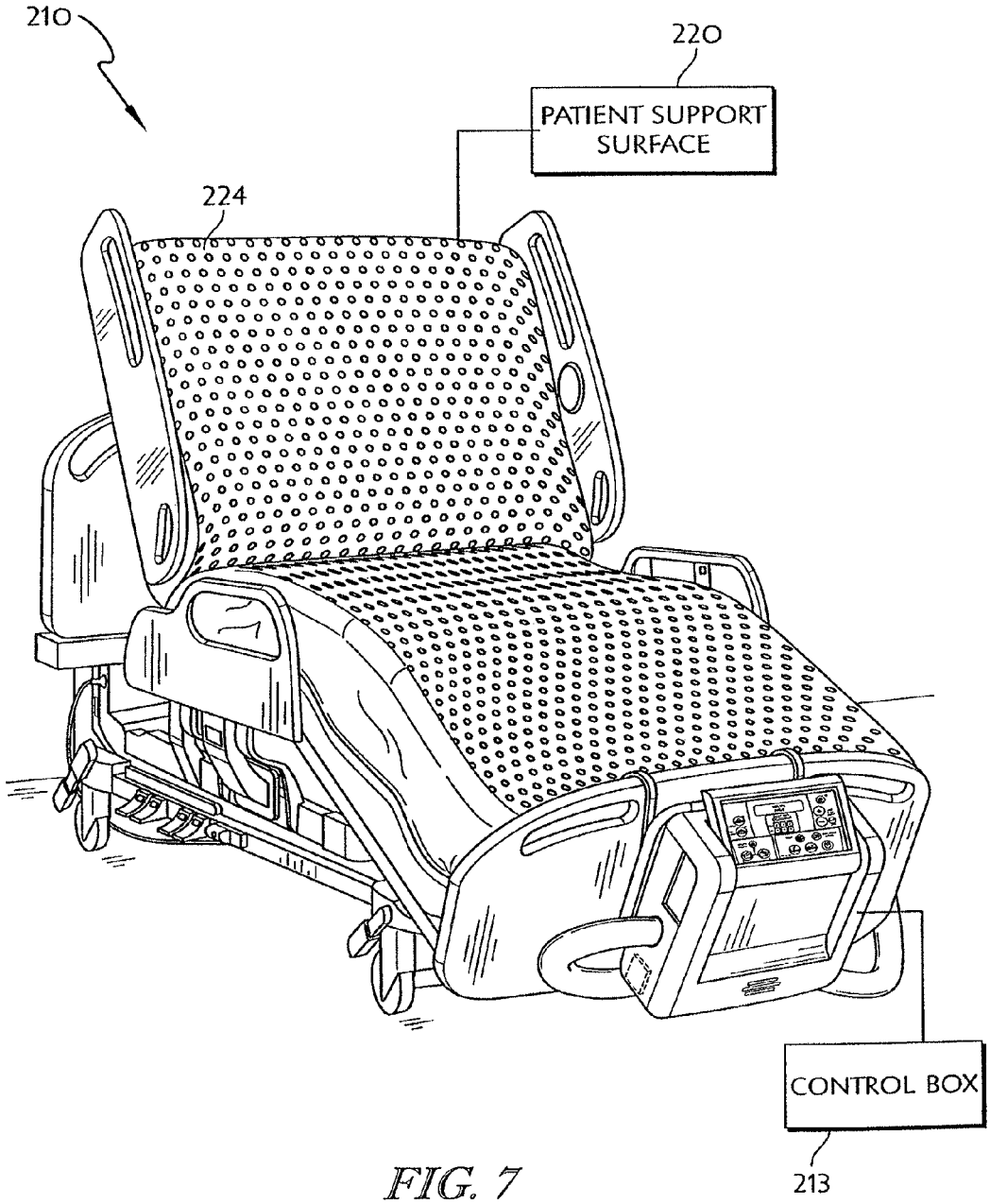
FIG. 7 is a front perspective view of a third embodiment of a patient support apparatus in accordance with the present disclosure.
Figure 8:
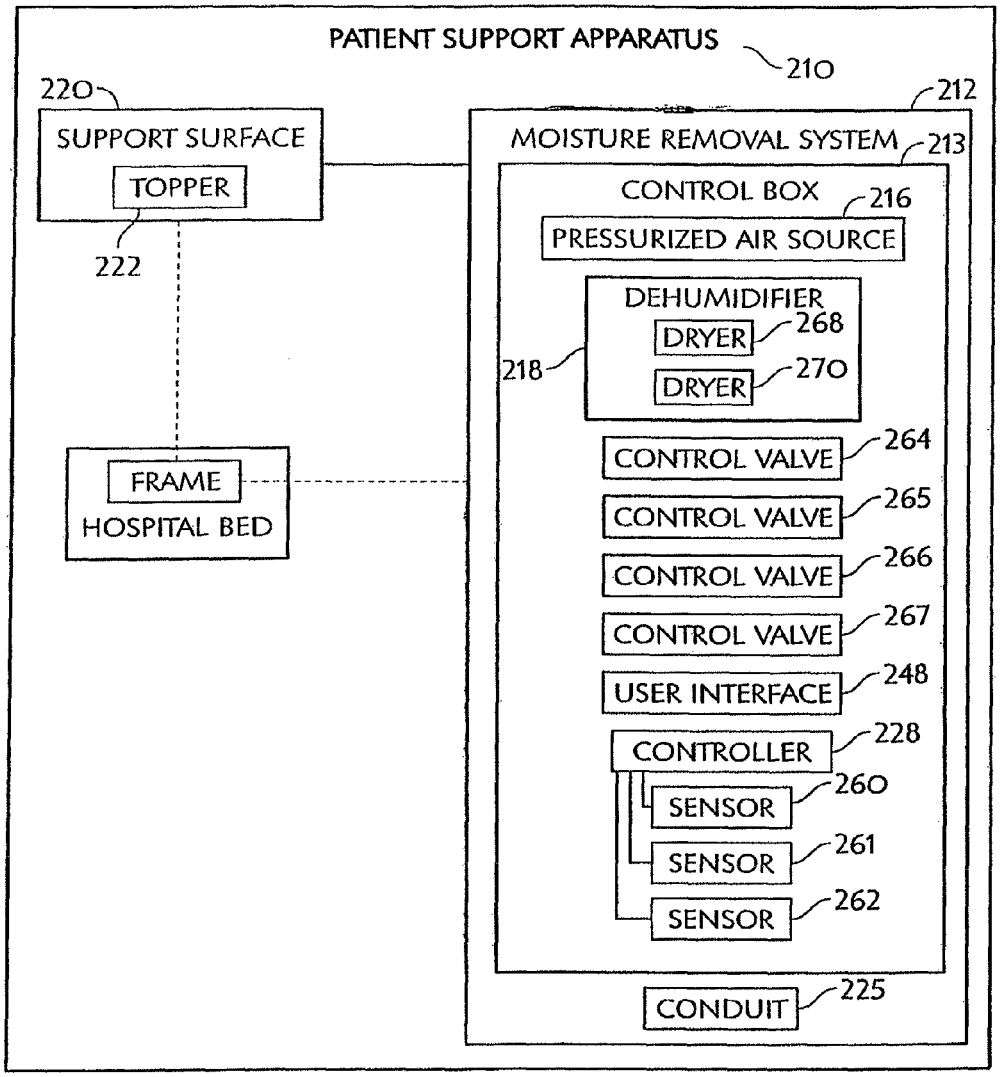
FIG. 8 is a diagrammatic view showing various components included in the patient support apparatus of FIG. 7.

Referring now to FIGS. 7-8, a patient support apparatus 210 is illustratively embodied as a moisture removal system 212 coupled to a support surface 220 in a third embodiment of the present disclosure. The moisture removal system 212 and the support surface 220 may each be coupled to a support frame included in a hospital bed. As an example, the moisture removal system 212 and the support surface 220 may each be coupled to the support frame 14 of the bed 10 described in the first embodiment of the present disclosure.

As shown in FIG. 7, the moisture removal system 212 is removably mounted to a footboard included in the hospital bed. The support surface 220 is removably coupled to the support frame included in the bed and arranged to underlie a patient supported on the support surface 220. The moisture removal system 212 is configured to cool and dry the support surface 220 to promote skin health by moving air along the support surface 220 when the patient is supported on the support surface 220.

The support surface 220 includes a topper 222 which defines a top face 224 of the support surface 220. The moisture removal system 212 includes a control box 213, including a pressurized air source 216 and a dehumidifier 218, and a conduit 225. The support surface 220 is configured to conduct pressurized air provided by the pressurized air source 216 through the conduit 225 to the support surface 220 along the top face 224 when the patient is supported on the support surface 220. The pressurized air provided by the pressurized air source 216 may be pressurized air which is treated using the dehumidifier 218 so that the moisture content of the pressurized air is reduced prior to being conducted along the top face 224 of the support surface 220. The pressurized air provided by the pressurized air source 216 may also be pressurized air that has not been treated using the dehumidifier 218 prior to being conducted along the top face 224 of the support surface 220.

For the purposes of the present disclosure, the support surface 220 of the third embodiment is considered to be similar to the support surface 20 of the first embodiment. The components included in the support surface 20 as shown in FIG. 1 are considered to be included in the support surface 220 as shown in FIG. 7.

The control box 213 includes a controller 228, a plurality of sensors, and a plurality of control valves as shown in FIG. 8. The control box 213 provides data regarding the moisture content of the pressurized air provided by the pressurized air source 216, including one or more relative humidity measurements taken at various locations in the moisture removal system 212. The control box 213 is configured to direct the operation of the dehumidifier 218 so that the dehumidifier 218 is operable to selectively treat the pressurized air provided by the pressurized air source 216.

Figure 9A:
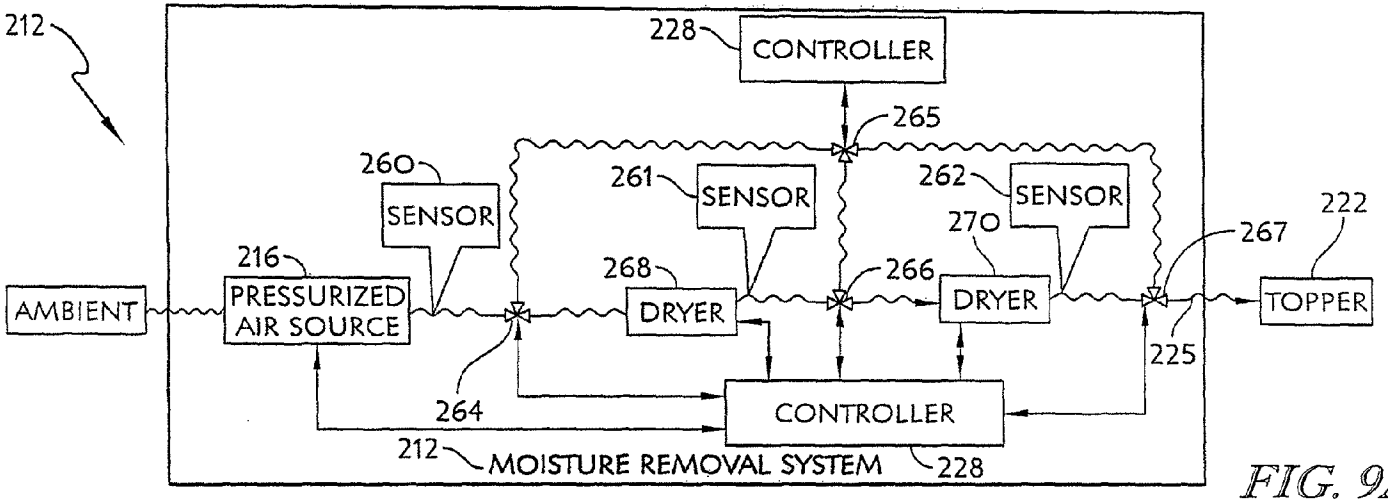
FIG. 9A is a diagrammatic view showing the various components of FIG. 8 in a first arrangement and associated paths of pressurized air flow therebetween.

Referring now to FIG. 8, the moisture removal system 212 includes the control box 213 and the conduit 225 as indicated above. The control box 213 includes the pressurized air source 216 and the dehumidifier 218 as indicated above. The pressurized air source 216 is configured to receive ambient air surrounding the support surface 220 and pressurize the ambient air so that it becomes pressurized air. The pressurized air source 216 is also configured to drive the pressurized air toward the dehumidifier 218 and the topper 222 as illustrated in FIG. 9A. The dehumidifier 218 receives pressurized air from the pressurized air source 216 as shown in FIG. 9A and includes a first dryer 268 and a second dryer 270. Each dryer 268, 270 is configured to treat the pressurized air by reducing the moisture content of the pressurized air that passes through the dryer and communicate the treated pressurized air toward the topper 222.

For the purposes of the present disclosure, the pressurized air source 216 of the third embodiment is considered to be similar to the pressurized air source 16 of the first embodiment. Similarly, each of the dryers 268, 270 of the third embodiment are considered to be similar to the dryers 68, 70 of the first embodiment.

The control box 213 also includes the plurality of sensors and the plurality of control valves as indicated above and shown in FIG. 8. The plurality of sensors includes a first sensor 260, a second sensor 261, and a third sensor 262 as shown in FIG. 8. The plurality of control valves includes a first control valve 264, a second control valve 265, a third control valve 266, and a fourth control valve 267 as shown in FIG. 8.

For the purposes of the present disclosure, the sensors 260, 261, 262 of the third embodiment are considered to be similar to the sensors 60, 61, 62 of the first embodiment. Similarly, the control valves 264, 265, 266, and 267 of the third embodiment are considered to be similar to the control valves 64, 65, 66, and 67 of the first embodiment.

Referring now to FIG. 9A, the moisture removal system 212 is arranged in a third configuration in the third embodiment of the present disclosure in which the dryers 268, 270 are placed in series with one another and the pressurized air source 216 is located upstream of each dryer 268, 270 relative to the ambient. For the purposes of the present disclosure, the third configuration of the third embodiment shown in FIG. 9A is considered to be similar to the first configuration of the first embodiment shown in FIG. 3A.

Figure 9B:
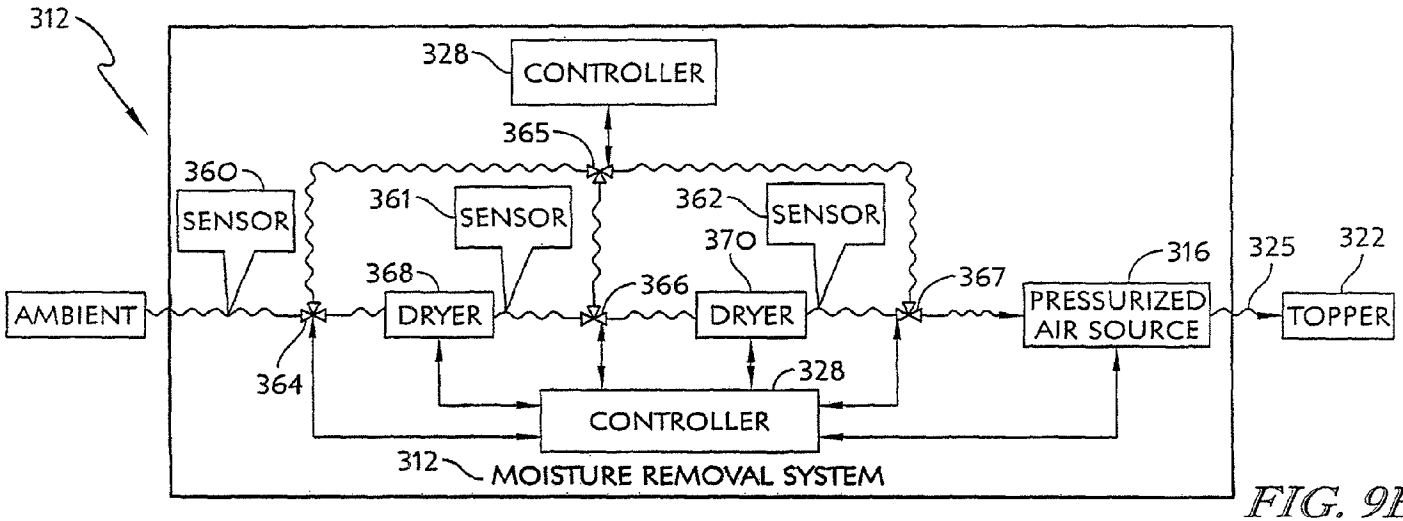
FIG. 9B is a diagrammatic view showing the various components of FIG. 8 in a second arrangement in accordance with a fourth embodiment of the present disclosure and showing associated paths of pressurized air flow therebetween.

Referring now to FIG. 9B, the moisture removal system 312 is arranged in a fourth configuration in a fourth embodiment of the present disclosure in which the dryers 368, 370 are placed in series with one another and the pressurized air source 316 is located downstream of each dryer 368, 370 relative to the ambient. For the purposes of the present disclosure, the fourth configuration of the fourth embodiment shown in FIG. 9B is considered to be similar to the second configuration of the second embodiment shown in FIG. 3B.

Figure 10:
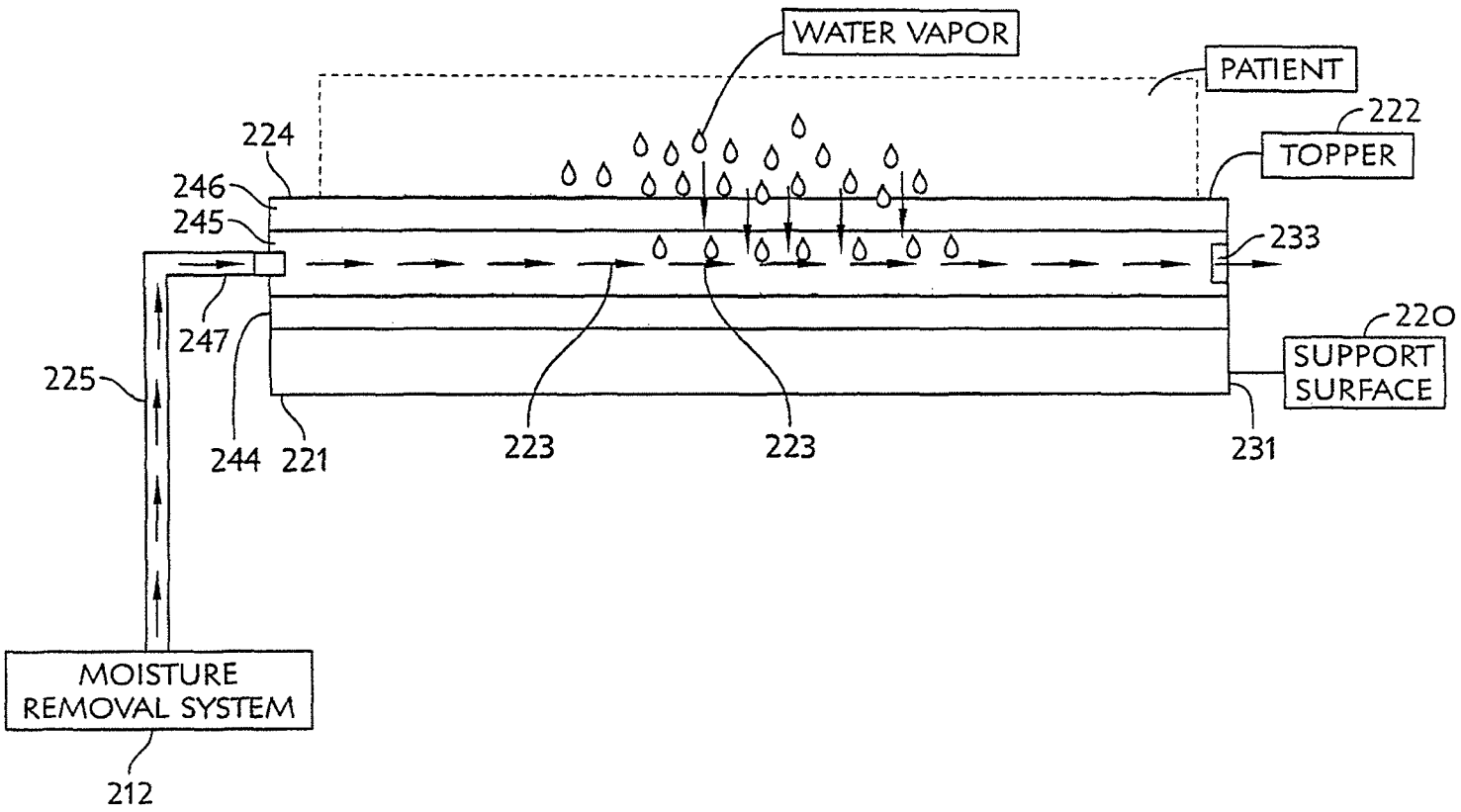
FIG. 10 is a side view of a support surface included in the patient support apparatus of FIG. 7 that includes a topper having pressurized air flowing therethrough.

Referring now to FIG. 10, the flow of pressurized air from the moisture removal system 212 through the topper 222 of the support surface 220 of the third embodiment of the present disclosure is shown. Treated pressurized air or non-treated pressurized air flows from the moisture removal system 212 to the topper 222 through the conduit 225 as shown in FIG. 10. The air provided by the moisture removal system 212 is communicated to the middle layer 245 of the topper 222 by a fitting 247 included in the support surface 220.

Air provided by the moisture removal system 212 to the topper 222 is conducted through the middle layer 245 in the direction shown by arrows 223 in FIG. 10. The air interacts with water vapor that passes through the vapor permeable top layer 246 and into the middle layer 245 as shown in FIG. 10. The water vapor originates from the patient resting on the support surface 220 as shown in FIG. 10.

Air provided by the moisture removal system 212 to the topper 222 evaporates the water vapor that passes into the middle layer 245 as suggested in FIG. 10. The evaporating air is communicated through the middle layer 245 from a foot end 221 to a head end 231 of the support surface 220 and toward an exhaust 233 formed in the head end 231 of the middle layer 245. The evaporating air is expelled through the exhaust 233 as shown in FIG. 10.

Figure 11A:
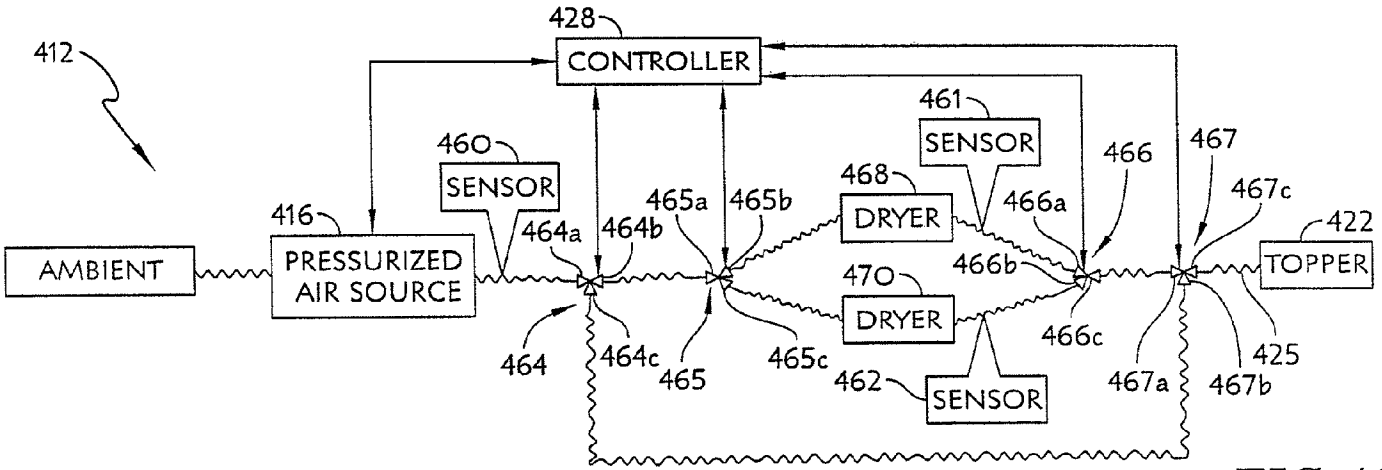
FIG. 11A is a diagrammatic view showing the various components of FIG. 8 in a third arrangement in accordance with a fifth embodiment of the present disclosure and showing associated paths of pressurized air flow therebetween.

Referring now to FIG. 11A, the moisture removal system 412 is arranged in a fifth configuration in a fifth embodiment of the present disclosure in which the dryers 468, 470 are placed in parallel with one another and the pressurized air source 416 is located upstream of each dryer 468, 470 relative to the ambient. The positions of the components included in the control box 413 relative to one another and the various flow paths therebetween for pressurized air provided by the pressurized air source 416 are described below.

As shown in FIG. 11A, the first sensor 460 is positioned between the pressurized air source 416 and the first control valve 464. The first sensor 460 is configured to provide a first relative humidity measurement of non-treated pressurized air that is communicated from the pressurized air source 416 toward the topper 422 to the controller 428.

As shown in FIG. 11A, the first control valve 464 is positioned between the first sensor 460 and the second control valve 465. The first control valve 464 is fluidly coupled to the pressurized air source 416 at a first inlet port 464*a* as shown in FIG. 11A. The first control valve 464 is fluidly coupled to the second control valve 465 at a second outlet port 464*b* as shown in FIG. 11A. The first control valve 464 is fluidly coupled to the fourth control valve 467 at a third outlet port 464*c* as shown in FIG. 11A.

As shown in FIG. 11A, the second control valve 465 is positioned between the first control valve 464 and the dehumidifier 418. The second control valve 465 is fluidly coupled to the first control valve 464 at a first port 465*a* as shown in FIG. 11A. The second control valve 465 is fluidly coupled to an inlet of the first dryer 468 at a second port 465*b* as shown in FIG. 11A. The second control valve 465 is fluidly coupled to an inlet of the second dryer 470 at a third port 465*c* as shown in FIG. 11A.

As shown in FIG. 11A, each of dryers 468, 470 is positioned between the second control valve 465 and the third control valve 466. The second sensor 461 is positioned between the first dryer 468 and the third control valve 466, and the third sensor 462 is positioned between the second dryer 470 and the third control valve 466 as shown in FIG. 11A. The second sensor 461 is configured to provide a second relative humidity measurement of treated pressurized air that is expelled from the first dryer 468 toward the topper 422 to the controller 428 and the third sensor 462 is configured to provide a third relative humidity measurement of treated pressurized air that is expelled from the second dryer 470 toward the topper 422 to the controller 428.

As shown in FIG. 11A, the third control valve 466 is positioned between the each of the sensors 461, 462 and the fourth control valve 467. The third control valve 466 is fluidly coupled to the first dryer 468 at a first port 466*a* as shown in FIG. 11A. The third control valve 466 is fluidly coupled to the second dryer 470 at a second port 466*b* as shown in FIG. 11A. The third control valve 466 is fluidly coupled to the fourth control valve 467 at a third port 466*c* as shown in FIG. 11A.

As shown in FIG. 11A, the fourth control valve 467 is positioned between the third control valve 466 and the topper 422. The fourth control valve 467 is fluidly coupled to the third control valve 466 at a first port 467*a* as shown in FIG. 11A. The fourth control valve 467 is fluidly coupled to the first control valve 464 at a second port 467*b* as shown in FIG. 11A. The fourth control valve 467 is fluidly coupled to the topper 422 at a third port 467*c* as shown in FIG. 11A.

Figure 11B:
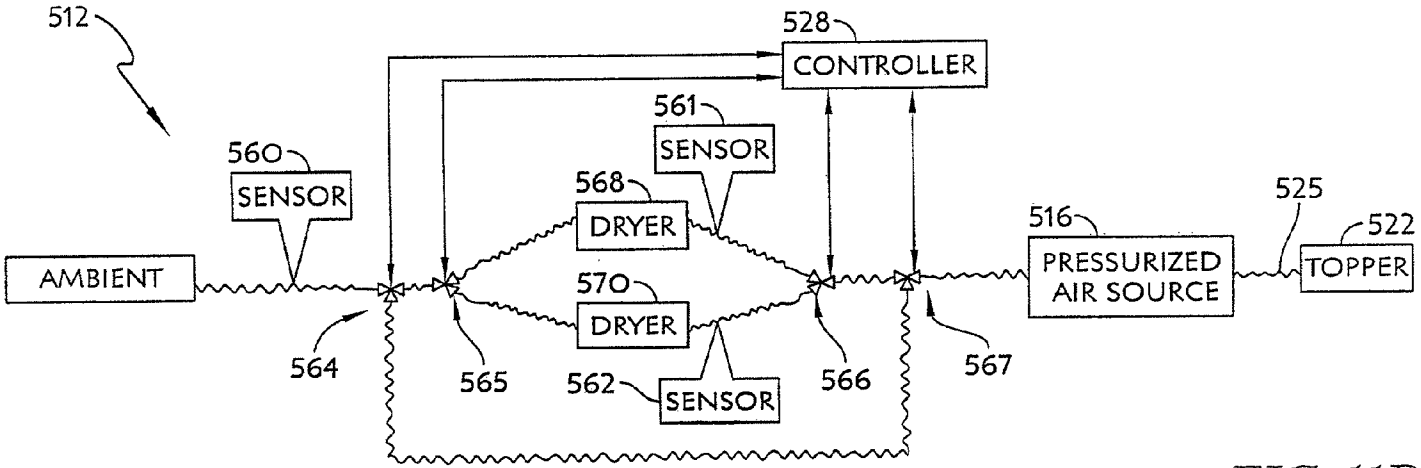
FIG. 11B is a diagrammatic view showing the various components of FIG. 8 in a fourth arrangement in accordance with a sixth embodiment of the present disclosure and showing associated paths of pressurized air flow therebetween.

Referring now to FIG. 11B, the moisture removal system 512 is arranged in a sixth configuration in a sixth embodiment of the present disclosure in which the dryers 568, 570 are placed in parallel with one another and the pressurized air source 516 is located downstream of each dryer 568, 570 relative to the ambient. The first sensor 560 is positioned between the ambient and the first control valve 564, and treated/non-treated pressurized air is communicated from the fourth control valve 567 to the pressurized air source 516. Air communicated to the pressurized air source 516 from the fourth control valve 567 is routed to the topper 522 thereafter through the conduit 525.

Except for the differences identified in the paragraph above, the fifth embodiment of the moisture removal system 412 illustrated in FIG. 11A is the same as the sixth embodiment of the moisture removal system 512 illustrated in FIG. 11B. In both the fifth and six embodiments the moisture removal systems 412, 512 are operable to communicate at least one of pressurized non-treated air, pressurized air treated by the first dryer 468, 568, or pressurized air treated by the second dryer 470, 570 to the topper 422, 522 through the conduit 425, 525 so that it is conducted along the top face (not shown) of the support surface 420, 520.

Figure 12:
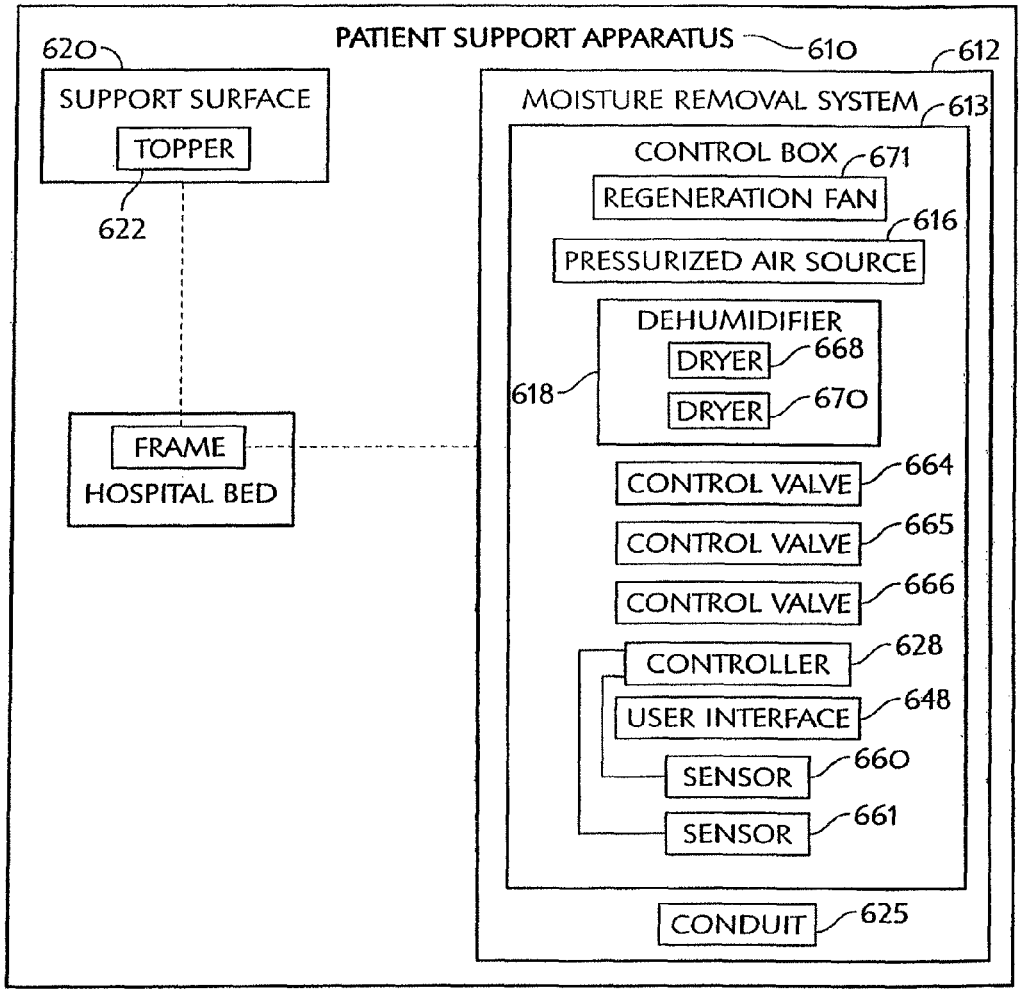
FIG. 12 is a diagrammatic view showing various components included in a patient support apparatus in a seventh embodiment of the present disclosure.
Figure 13:
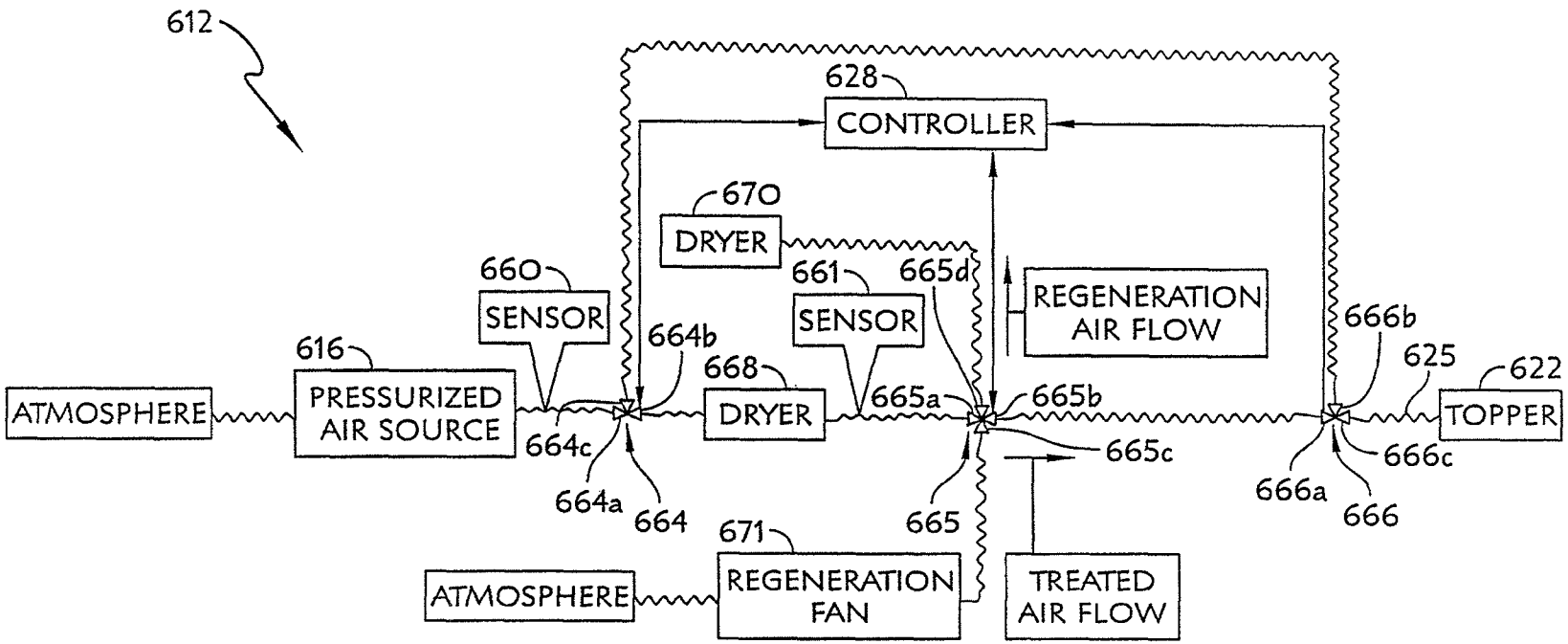
FIG. 13 is a diagrammatic view showing the various components of FIG. 12 in a first arrangement and associated paths of pressurized air flow therebetween.

Referring now to FIGS. 12-13, a patient support apparatus 610 is illustratively embodied as a moisture removal system 612 coupled to a support surface 620 in a seventh embodiment of the present disclosure. The moisture removal system 612 and the support surface 620 may each be coupled to a support frame included in a hospital bed. As an example, the moisture removal system 612 and the support surface 620 may each be coupled to the support frame 14 of the bed 10 described in the first embodiment of the present disclosure.

For the purposes of the present disclosure, the moisture removal system 612 may be removably mounted to a footboard included in the hospital bed similar to the third embodiment of the present disclosure. The support surface 620 may be removably coupled to the support frame included in the bed and arranged to underlie a patient supported on the support surface 620 similar to the third embodiment of the present disclosure. The moisture removal system 612 is configured to cool and dry the support surface 620 to promote skin health by moving air along the support surface 620 when the patient is supported on the support surface 620.

The support surface 620 includes a topper 622 which forms a top face (not shown) of the support surface 620 similar to the third embodiment of the present disclosure. The moisture removal system 613 includes a control box 213, including a pressurized air source 616 and a dehumidifier 618, and a conduit 625 as shown in FIG. 12. The support surface 620 is configured to conduct pressurized air provided by the pressurized air source 616 through the conduit 625 to the support surface 620 and along the top face when the patient is supported on the support surface 620. The pressurized air provided by the pressurized air source 616 may be pressurized air which is treated using the dehumidifier 618 so that the moisture content of the air is reduced prior to being conducted along the top face of the support surface 620. The pressurized air provided by the pressurized air source 216 may also be pressurized air that has not been treated using the dehumidifier 618 prior to being conducted along the top face of the support surface 620.

For the purposes of the present disclosure, the support surface 620 of the seventh embodiment is considered to be similar to the support surface 20 of the first embodiment. The components included in the support surface 20 as shown in FIG. 1 are considered to be included in the support surface 620.

The control box 613 includes a controller 628, a plurality of sensors, a plurality of control valves, and a regeneration fan 671 as shown in FIG. 12. The control box 613 provides data regarding the moisture content of the pressurized air provided by the pressurized air source 616, including one or more relative humidity measurements taken at various locations in the moisture removal system 612. The control box 613 is configured to direct the operation of the dehumidifier 618 to selectively treat the pressurized air provided by the pressurized air source 616. As will be discussed below, the regeneration fan 671 is configured to provide pressurized air to regenerate the desiccant included in one of the dryers of the dehumidifier 618 while the other dryer is being used to treat the pressurized air provided by the pressurized air source 616.

The moisture removal system 612 includes the control box 613 and the conduit 625 as shown in FIG. 13 and as indicated above. The control box 613 includes the pressurized air source 616 and the dehumidifier 618 as indicated above. The pressurized air source 616 is configured to receive ambient or atmospheric air surrounding the support surface 620 and drive the air toward the dehumidifier 618 and the topper 622 as illustrated in FIG. 13. The dehumidifier 618 includes a first dryer 668 and a second dryer 670 as shown in FIG. 13. At least one of the dryers 668, 670 is configured to receive pressurized air from the pressurized air source 616 as shown in FIG. 13. Each dryer 668, 670 is configured to treat the pressurized air provided by the pressurized air source 616 by reducing the moisture content of the air and thereafter communicating the treated air toward the topper 622.

For the purposes of the present disclosure, the pressurized air source 616 of the seventh embodiment is considered to be similar to the pressurized air source 16 of the first embodiment. Similarly, each of the dryers 668, 670 of the seventh embodiment is considered to be similar to the dryers 68, 70 of the first embodiment.

The control box 613 includes the controller 628 and a user interface 648 as shown in FIG. 12. For the purposes of the present disclosure, the controller 628 of the seventh embodiment is similar to the controller 28 of the first embodiment. The user interface 648 of the seventh embodiment is considered to be similar to the user interface 48 of the first embodiment.

The control box 613 also includes the plurality of sensors and the plurality of control valves as indicated above and shown in FIG. 12. The plurality of sensors includes a first sensor 660 and a second sensor 661 as shown in FIG. 12. The plurality of control valves includes a first control valve 664, a second control valve 665, and a third control valve 666 as shown in FIG. 12.

Each of the sensors 660, 661 of the seventh embodiment is illustratively a relative humidity sensor coupled to the controller 628 and configured to provide a relative humidity measurement to the controller 628 of pressurized air provided by the pressurized air source 616 and conducted through the moisture removal system 612 to the support surface 620. Each of the sensors 660, 661 is an input device providing the relative humidity measurement to the controller 628 as an input signal similar to each of the sensors 60, 61, 62 of the first embodiment.

Each of the control valves 664, 666 is illustratively a 3-way valve configured to permit air flow between two of three different ports included in each control valve as shown in FIG. 13. Each of the control valves 664, 666 is coupled to the controller 628 as shown in FIG. 13. Each of the control valves 664, 666 is an output device configured to receive an output signal from the controller 628, similar to each of the valves 64, 65, 66, 67 of the first embodiment.

The second control valve 665 is illustratively a 4-way valve configured to permit air flow between four different ports as shown in FIG. 13. The second control valve 665 is coupled to the controller 628 as shown in FIG. 13. The second control valve 665 is an output device configured to receive an output signal from the controller 628, similar to the first control valve 664 and the third control valve 666.

Referring to FIG. 13, the moisture removal system 612 is arranged so that the first dryer 668 receives pressurized air from the pressurized air source 616 and the second dryer 670 receives pressurized air from a regeneration fan 671. As discussed below, the first dryer 668 treats the pressurized air provided by the pressurized air source 616 while the second dryer 670 receives pressurized air from the regeneration fan 671 to regenerate the desiccant included in the second dryer 670. The positions of the components included in the control box 613 relative to one another and the various flow paths therebetween for pressurized air provided by the pressurized air source 616 and the regeneration fan 671 are described below.

As shown in FIG. 13, the first sensor 660 is positioned between the pressurized air source 616 and the first control valve 664. The first sensor 660 is configured to provide a first relative humidity measurement of non-treated pressurized air that is expelled from the pressurized air source 616 toward the topper 622 to the controller 628.

As shown in FIG. 13, the first control valve 664 is positioned between the first sensor 660 and the first dryer 668. The first control valve 664 is fluidly coupled to the pressurized air source 616 at a first inlet port 664*a* as shown in FIG. 13. The first control valve 664 is fluidly coupled to the first dryer 668 at a second outlet port 664*b* as shown in FIG. 13. The first control valve 664 is fluidly coupled to the third control valve 666 at a third outlet port 664*c* as shown in FIG. 13.

As shown in FIG. 13, the first dryer 668 is positioned between the first control valve 664 and the second control valve 665. The second sensor 661 is positioned between the first dryer 268 and the second control valve 265. The second sensor 661 is configured to provide a second relative humidity measurement of treated pressurized air that is expelled from the first dryer 668 toward the topper 622 to the controller 628.

As shown in FIG. 13, the second control valve 665 is positioned between the second sensor 661 and the third control valve 666. The second control valve 665 is fluidly coupled to the first dryer 668 at a first port 665*a* as shown in FIG. 13. The second control valve 665 is fluidly coupled to the third control valve 666 at a second port 665*b* as shown in FIG. 13. The second control valve 665 is fluidly coupled to the regeneration fan 671 at a third port 665*c* as shown in FIG. 13. The second control valve 665 is fluidly coupled to the second dryer 670 at a fourth port 665*d* as shown in FIG. 13.

As shown in FIG. 13, the regeneration fan 671 receives ambient air and communicates the ambient air to the third port 665*c* of the second control valve 665. For the purposes of the present disclosure, the regeneration fan 671 may be similar to the pressurized air source 616. Air flow from the regeneration fan 671 to the third port 665*c* and to the second dryer 670 through the fourth port 665*d* is referred to as 'regeneration air flow' as shown in FIG. 13.

As shown in FIG. 13, treated pressurized air expelled from the first dryer 668 is communicated to the first port 665*a* and to the third control valve 666 through the second port 665*b*. Air flow from the first dryer 668 to the first port 665*a* and to the third control valve 666 through the second port 665*b* is referred to as 'treated air flow' as shown in FIG. 13. It should be understood that the second control valve 665 is operable to permit 'regeneration air flow' between ports 665*c*, 665*d* and 'treated air flow' between ports 665*a*, 665*b* simultaneously. In this manner, the desiccant included in the second dryer 670 may be regenerated at the same time the first dryer 668 treats pressurized air provided by the pressurized air source 616.

As shown in FIG. 13, the third control valve 666 is positioned between the second control valve 665 and the topper 622. The third control valve 666 is fluidly coupled to the second control valve 665 at a first port 666*a* as shown in FIG. 13. The third control valve 666 is fluidly coupled to the first control valve 664 at a second port 666*b* as shown in FIG. 13. The third control valve 666 is fluidly coupled to the topper 622 at a third port 666*c* as shown in FIG. 13.

In the arrangement shown in FIG. 13, the moisture removal system 612 is operable to communicate at least one of pressurized non-treated air or pressurized treated air to the topper 622 through the conduit 625 so that it is conducted along the top face of the support surface 620. The pressurized treated air is communicated toward the topper 622 by the first dryer 668 while the desiccant of the second dryer 670 is being regenerated as shown in FIG. 13.

In other configurations, the pressurized air may be treated and communicated toward the topper 622 by the second dryer 670 while the desiccant of the first dryer 668 is being regenerated. In other configurations, the pressurized air source 616 may be positioned downstream of the dehumidifier 618 relative to the ambient such that the first control valve 664 receives air from the ambient and the third control valve 666 provides one of treated pressurized air or non-treated pressurized air to the pressurized air source 616 through the third port 666*c*.

Figure 14:
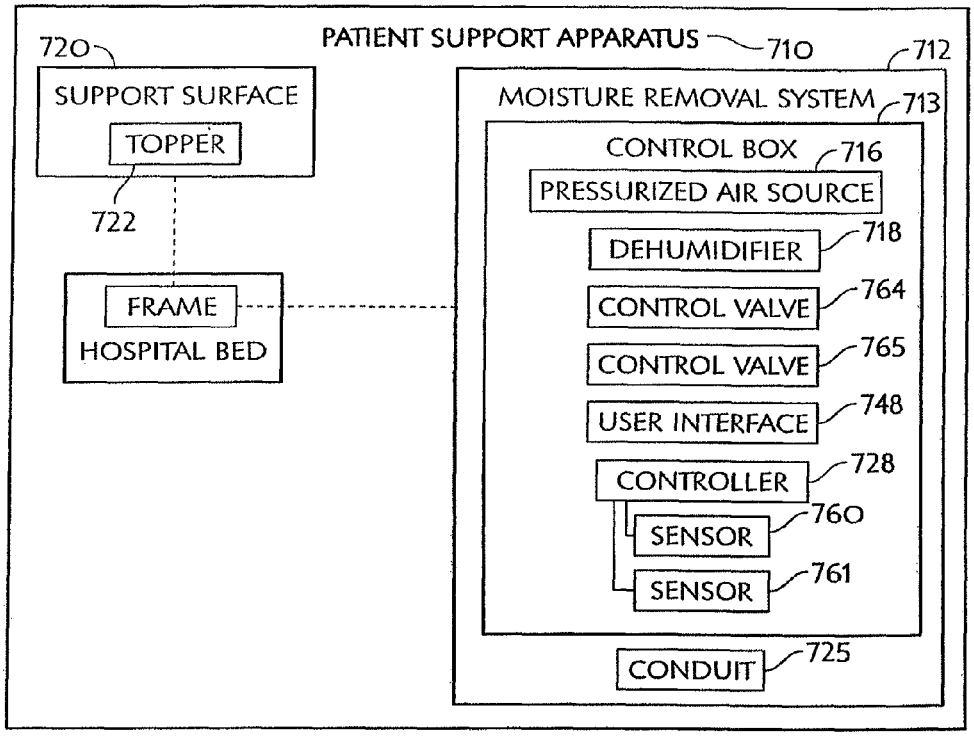
FIG. 14 is a diagrammatic view of an eighth embodiment of a patient support apparatus in accordance with the present disclosure and various components included therein.
Figure 15:
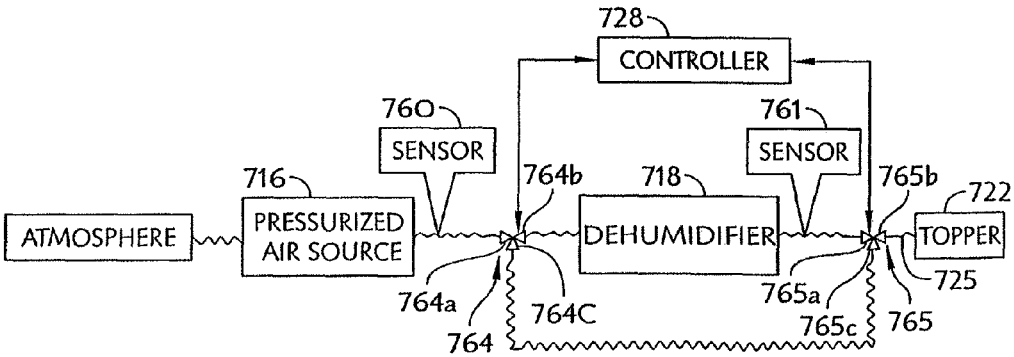
FIG. 15 is a diagrammatic view of the various components of FIG. 14 in a first arrangement and associated paths of pressurized air flow therebetween.

Referring now to FIGS. 14-15, a patient support apparatus 710 is illustratively embodied as a moisture removal system 712 coupled to a support surface 720 in an eighth embodiment of the present disclosure. The moisture removal system 712 and the support surface 720 may each be coupled to a support frame included in a hospital bed. As an example, the moisture removal system 712 and the support surface 720 may each be coupled to the support frame 14 of the bed 10 described in the first embodiment of the present disclosure.

For the purposes of the present disclosure, the moisture removal system 712 may be removably mounted to a footboard included in the hospital bed similar to the third embodiment of the present disclosure. The support surface 720 may be removably coupled to the support frame included in the bed and arranged to underlie a patient supported on the support surface 720 similar to the third embodiment of the present disclosure. The moisture removal system 712 is configured to cool and dry the support surface 720 to promote skin health by moving air along the support surface 720 when the patient is supported on the support surface 720.

The support surface 720 includes a topper 722 which forms a top face (not shown) of the support surface 720. The moisture removal system 712 includes a control box 713, including a pressurized air source 716 and a dehumidifier 718, and a conduit 725 as shown in FIG. 14. The support surface 720 is configured to conduct pressurized air provided by the pressurized air source 716 through the conduit 725 to the support surface 720 and along the top face when the patient is supported on the support surface 720. The pressurized air provided by the pressurized air source 716 may be pressurized air which is treated using the dehumidifier 718 so that the moisture content of the air is reduced prior to being conducted along the top face of the support surface 720. The pressurized air provided by the pressurized air source 316 may also be pressurized air that is not treated using the dehumidifier 718 prior to being conducted along the top face of the support surface 720.

For the purposes of the present disclosure, the support surface 720 of the eighth embodiment is considered to be similar to the support surface 20 of the first embodiment. The components included in the support surface 20 as shown in FIG. 1 are considered to be included in the support surface 720.

The control box 713 includes a controller 728, a plurality of sensors, and a plurality of control valves as shown in FIG. 14. The control box 713 provides data regarding the moisture content of the pressurized air provided by the pressurized air source 716, including one or more relative humidity measurements taken at various locations in the moisture removal system 712. The control box 713 is configured to direct the operation of the dehumidifier 718 to selectively treat the pressurized air provided by the pressurized air source 716.

Referring to FIG. 14, the moisture removal system 712 includes the control box 713 and the conduit 725 as indicated above. The control box 713 includes the pressurized air source 716 and the dehumidifier 718 as indicated above. The pressurized air source 716 is configured to receive ambient air surrounding the support surface 720 and drive the air toward the dehumidifier 718 and the topper 722 as illustrated in FIG. 15. The dehumidifier 718 is configured to treat the pressurized air provided by the pressurized air source 716 by reducing the moisture content of the air and thereafter communicating the treated air toward the topper 722.

For the purposes of the present disclosure, the pressurized air source 716 of the eighth embodiment is considered to be similar to the pressurized air source 16 of the first embodiment. Similarly, the dehumidifier 718 of the eighth embodiment is considered to be similar to each of the dryers 68, 70 of the first embodiment.

The control box 713 includes the controller 728 and a user interface 748 as shown in FIG. 14. For the purposes of the present disclosure, the controller 728 of the eighth embodiment is similar to the controller 28 of the first embodiment. The user interface 748 of the eighth embodiment is considered to be similar to the user interface 48 of the first embodiment.

The control box 713 also includes the plurality of sensors and the plurality of control valves as indicated above and shown in FIG. 14. The plurality of sensors includes a first sensor 760 and a second sensor 761 as shown in FIG. 14. The plurality of control valves includes a first control valve 764 and a second control valve 765 as shown in FIG. 14.

Each of the sensors 760, 761 of the eighth embodiment is illustratively a relative humidity sensor coupled to the controller 728 and configured to provide a relative humidity measurement to the controller 728 of pressurized air provided by the pressurized air source 716 and conducted through the moisture removal system 712 to the support surface 720. Each of the sensors 760, 761 is an input providing the relative humidity measurement to the controller 728 as an input signal similar to each of the sensors 60, 61, 62 of the first embodiment.

Each of the control valves 764, 765 is illustratively a 3-way valve configured to permit air flow between two of three different ports included in each control valve as shown in FIG. 15. Each of the control valves 764, 765 is coupled to the controller 728 as shown in FIG. 15. Each of the control valves 764, 765 is an output configured to receive an output signal from the controller 728, similar to each of the valves 64, 65, 66, 67 of the first embodiment.

Referring to FIG. 15, the moisture removal system 712 is arranged so that the dehumidifier 718 receives pressurized air from the pressurized air source 716. The positions of the components included in the control box 713 relative to one another and the various flow paths therebetween for pressurized air provided by the pressurized air source 716 are described below.

As shown in FIG. 15, the first sensor 760 is positioned between the pressurized air source 716 and the first control valve 764. The first sensor 760 is configured to provide a first relative humidity measurement of non-treated pressurized air that is expelled from the pressurized air source 716 toward the topper 722 to the controller 728.

As shown in FIG. 15, the first control valve 764 is positioned between the first sensor 760 and the dehumidifier 718. The first control valve 764 is fluidly coupled to the pressurized air source 716 at a first inlet port 764*a* as shown in FIG. 15. The first control valve 764 is fluidly coupled to the dehumidifier 718 at a second outlet port 764*b* as shown in FIG. 15. The first control valve 764 is fluidly coupled to the second control valve 765 at a third outlet port 764*c* as shown in FIG. 15.

As shown in FIG. 15, the dehumidifier 718 is positioned between the first control valve 764 and the second control valve 765. The second sensor 761 is positioned between the dehumidifier 718 and the second control valve 765. The second sensor 761 is configured to provide a second relative humidity measurement of treated pressurized air that is expelled from the dehumidifier 718 toward the topper 722 to the controller 728.

As shown in FIG. 15, the second control valve 765 is positioned between the second sensor 761 and the topper 722. The second control valve 765 is fluidly coupled to the dehumidifier 718 at a first port 765*a* as shown in FIG. 15. The second control valve 765 is fluidly coupled to the first control valve 764 at a second port 765*c* as shown in FIG. 15. The second control valve 765 is fluidly coupled to the topper 722 at a third port 765*b* as shown in FIG. 15.

In the configuration shown in FIG. 15, the moisture removal system 712 is operable to communicate at least one of pressurized non-treated air or pressurized treated air to the topper 722 through the conduit 725 so that it is conducted along the top face of the support surface 720. Non-treated pressurized air is communicated from the third port 764*c* of the first control valve 764 to the second port 765*c* of the second control valve 765 and thereafter to the topper 722 through the conduit 725, thereby bypassing the dehumidifier 718.

In other configurations, the dehumidifier 718 may not contain a heat source usable to regenerate the desiccant included in the dehumidifier 718 once the desiccant becomes saturated and is no longer able to absorb moisture from the pressurized air provided by the pressurized air source 716. The dehumidifier 718 may be removed from the moisture removal system 712 so that the saturated desiccant may be replaced with unsaturated desiccant. An external heat source may also be used to regenerate the saturated desiccant in the event that replacement of the desiccant is undesirable. The dehumidifier 718 may be bypassed once it is determined that the desiccant is saturated.

In other configurations, the pressurized air source 716 may be positioned downstream of the dehumidifier 718 relative to the ambient such that the first control valve 764 receives air from the ambient and the second control valve 765 provides one of treated pressurized air or non-treated pressurized air to the pressurized air source 716 through the second port 765*b*. Air communicated to the pressurized air source 716 may be communicated thereafter to the topper 722 through the conduit 725.

Although certain illustrative embodiments have been described in detail above, variations and modifications exist within the scope and spirit of this disclosure as described and as defined in the following claims.

The invention claimed is:

1. A patient support apparatus comprising:

a patient support surface including a topper, the topper having an upwardly-facing surface, the upwardly-facing surface being vapor permeable, a source of pressurized air, a dehumidification system in fluid communication with the source of pressurized air to receive pressurized air therefrom, the dehumidification system operable to selectively treat the pressurized air to reduce the moisture content of the pressurized air, the dehumidification system including a first dryer including a first desiccant and a first regenerator operable to regenerate the desiccant in the first dryer, a second dryer including a second desiccant and a second regenerator operable to regenerate the desiccant in the second dryer, a plurality of valves operable to vary the flow of pressurized air through the dehumidification system such that the flow of pressurized air may be selectively conducted through only one of the first and second dryers, neither of the first and second dryers, or both of the first and second dryers, and a conduit coupled to the dehumidification system to conduct the pressurized air from the dehumidification system to the topper.

2. The patient support apparatus of claim 1, wherein the pressurized air source is a blower that is coupled to the dehumidification system and configured to drive pressurized air toward the topper.

3. The patient support apparatus of claim 1, wherein the first regenerator includes a first heat source configured to regenerate the first desiccant.

4. The patient support apparatus of claim 1, wherein the pressurized air source is a compressor that is coupled to the dehumidification system and configured to drive pressurized air toward the topper.

5. The patient support apparatus of claim 1, wherein the pressurized air source is a blower that is coupled to the dehumidification system and configured to drive pressurized air toward the topper.

6. The patient support apparatus of claim 5, the plurality of valves comprising a first control valve fluidly coupling the blower to the first dryer, wherein the first control valve is operable to selectively direct pressurized air communicated to the first control valve from the blower to at least one of the first dryer and a second control valve, and wherein the first dryer is bypassed when the first control valve directs pressurized air to the second control valve.

7. The patient support apparatus of claim 6, further comprising a controller including a processor and memory having instructions stored therein, wherein the first control valve is coupled to the controller and the instructions are executable by the processor to cause the first control valve to direct pressurized air communicated to the first control valve by the blower to either the first dryer or the second control valve.

8. The patient support apparatus of claim 7, further comprising a user interface including a display and a sensor coupled to the controller and configured to measure the relative humidity of the pressurized air communicated from the blower to the first control valve and communicate the relative humidity measurement to the controller so that the measurement is displayed on the display.

9. The patient support apparatus of claim 6, wherein the pressurized air source is fluidly coupled to a first port included in the first control valve and the first dryer is fluidly coupled to a second port included in the first control valve.

10. The patient support apparatus of claim 9, wherein the first dryer is fluidly coupled to a first port included in the second control valve and the second dryer is fluidly coupled to a second port included in the second control valve.

11. The patient support apparatus of claim 10, further comprising a third control valve, wherein the second dryer is fluidly coupled to a first port included in the third control valve and the conduit is fluidly coupled to a second port included in the third control valve.

12. The patient support apparatus of claim 11, further comprising a fourth control valve, wherein the first control valve is fluidly coupled to a first port included in the fourth control valve and the third control valve is fluidly coupled to a second port included in the fourth control valve.

13. The patient support apparatus of claim 12, further comprising a first sensor configured to measure the relative humidity of pressurized air communicated from the pressurized air source to the first port of the first control valve.

14. The patient support apparatus of claim 13, further comprising a second sensor configured to measure the relative humidity of pressurized air communicated from the first dryer to the first port of the second control valve.

15. A patient support apparatus comprising:

a patient support surface including a topper, the topper having an upwardly-facing surface, the upwardly-facing surface being vapor permeable, a pressurized air source, a dehumidification system in fluid communication with the pressurized air source, the dehumidification system operable to selectively reduce the moisture content of ambient air provided to the dehumidifier so that it becomes treated air and communicate treated air to the pressurized air source, the dehumidification system including a first dryer including a first desiccant and a first regenerator operable to regenerate the desiccant in the first dryer, a second dryer including a second desiccant and a second regenerator operable to regenerate the desiccant in the second dryer, a plurality of valves operable to vary the flow of pressurized air through the dehumidification system such that the flow of pressurized air may be selectively conducted through only one of the first and second dryers, neither of the first and second dryers, or both of the first and second dryers, and a conduit coupled to the pressurized air source to conduct treated air from the pressurized air source to the topper.

16. The patient support apparatus of claim 15, wherein the first regenerator includes a first heat source configured to regenerate the first desiccant.

17. The patient support apparatus of claim 16, wherein the second regenerator includes a second heat source configured to regenerate the second desiccant.

18. The patient support apparatus of claim 17, the plurality of valves comprising a first control valve and a second control valve fluidly coupled to the first control valve, wherein ambient air is provided to the first control valve and the first control valve is operable to selectively direct ambient air to at least one of the first dryer and the second control valve, and wherein the first dryer is bypassed when the first control valve directs ambient air to the second control valve.

19. The patient support apparatus of claim 18, further comprising a controller including a processor and memory having instructions stored therein, wherein the first control valve is coupled to the controller and the instructions are executable by the processor to cause the first control valve to direct ambient air to the first dryer.

20. The patient support apparatus of claim 19, wherein the instructions are executable by the processor to cause the first control valve to direct ambient air to the second control valve to bypass the first dryer.

* * * * *